US005472371A

United States Patent [19]

Yamakura et al.

[11] Patent Number: 5,472,371

[45] Date of Patent: Dec. 5, 1995

[54] METHOD AND APPARATUS FOR TRUING AND TRUED GRINDING TOOL

[75] Inventors: Hideo Yamakura, Fujisawa; Toshio Tamura, Yokohama; Yuji Ochiai, Oota; Shigeo Aikawa, Yokohama, all of Japan

[73] Assignee: Hitachi, Ltd., Tokyo, Japan

[21] Appl. No.: 240,210

[22] Filed: May 9, 1994

Related U.S. Application Data

[62] Division of Ser. No. 909,213, Jul. 6, 1992, abandoned.

[30] Foreign Application Priority Data

Jul. 9, 1991 [JP] Japan ..... 3-193714

[51] Int. Cl.[6] ..... B24B 1/00; B24B 53/00

[52] U.S. Cl. ..... 451/56; 451/72; 125/11.18; 125/11.19

[58] Field of Search ..... 451/56, 72, 67; 125/11.01, 11.03, 11.18, 11.19

[56] References Cited

U.S. PATENT DOCUMENTS

| | | | |
|---|---|---|---|
| 4,073,281 | 2/1978 | Asaeda et al. | 125/11.03 |
| 4,151,684 | 5/1979 | Wada et al. | 125/11.03 |
| 4,182,082 | 1/1980 | Meyer | 125/11.03 |
| 4,557,078 | 12/1985 | Brill | 125/11.03 |
| 4,607,607 | 8/1986 | Janutta et al. | 125/11.03 |
| 4,757,645 | 7/1988 | Ozer et al. | 51/206 R |
| 5,108,561 | 4/1992 | Kuromatsu | 204/129.46 |
| 5,178,497 | 4/1990 | Kitabayashi | 51/206 R |
| 5,194,126 | 3/1993 | Packalin | 204/129.46 |

FOREIGN PATENT DOCUMENTS

| | | |
|---|---|---|
| 63-68365 | 3/1988 | Japan . |
| 1-188266 | 7/1989 | Japan . |

OTHER PUBLICATIONS

JSPE–52–02–02–1986, "Studies on Truing of Diamond Vitrified Wheels", pp. 91–96.

*Primary Examiner*—Maurina T. Rachuba

*Attorney, Agent, or Firm*—Fay, Sharpe, Beall, Fagan, Minnich & McKee

[57] ABSTRACT

By grinding the grinding surface of a diamond grinding tool which is formed in a predetermined shape by securing diamond abrasive grains by bond circularly or flat with high accuracy by the processing type truing method, uniformly dressing the above bond surface so as to project diamond abrasive grains, lapping the tips of the diamond abrasive grains projected from the above bond by the lapping type truing method so as to make the cutting edge height constant, the run,out of the grinding surface can be controlled to the order of submicrons and the cutting edges which are tips of the diamond abrasive grains can be aligned precisely.

16 Claims, 11 Drawing Sheets

100 μm

5 μm

METHOD AND APPARATUS FOR TRUING AND TRUED GRINDING TOOL

This is a divisional application of Ser. No. 07/909,213, filed Jul. 6, 1992, abandoned.

TITLE OF THE INVENTION

A Method and Apparatus for Truing and A Trued Grinding Tool

BACKGROUND OF THE INVENTION

1. Field of the Invention

The present invention relates to a method and apparatus for truing grinding tools and to tools ground by them. More specifically, the invention relates to a diamond grinding tool, a truing method and apparatus therefor, and a magnetic head which is finished by grinding by this grinding tool.

2. Description of the Prior Art

FIG. 17(*a*) shows the structure of a metal bond diamond grinding tool before truing, FIG. 17(*b*) shows the structure of the metal bond diamond grinding tool after truing, and FIG. 18 is a schematic view of the cutting edge condition of abrasive grains of the diamond grinding tool before truing.

To control the run out V of a grinding tool and correct the shape of the grinding tool is generally referred to as truing and to remove the bond and project abrasive grains is referred to as dressing. In the case of a diamond grinding tool 3 before truing, as shown in FIGS. 17(*a*) and 18, the cutting edge height of diamond abrasive grains 1, that is, the height of the tips of the diamond abrasive grains 1 is not constant.

Conventional diamond grinding tool truing methods are a method for processing a target grinding tool using a GC tool (grinding tool with SiC) as a tool, a method for processing a dressing tool, and a method for melting bond by discharge. These methods are described in "Studies on Truing of Diamond Vitrified Wheels" (JSPE 52-02-1986) and Japanese Patent Laid-Open No. 1989-188266, such truing methods designed to eliminate the run out of a grinding tool by removing the bond which is founded on drop out of grain.

FIG. 19 is a schematic view of the surface condition of a diamond grinding tool which is trued by the conventional truing method.

According to the conventional truing method, bond 2' is removed by truing, and diamond abrasive grains 1' supported by this bond 2' are dropped out, and excessively projected diamond abrasive grains 1' are removed. However, according to this truing method, the hardness of abrasive grains which are a tool is lower than the hardness of diamond abrasive grains 1 to be processed and hence the diamond abrasive grains 1 cannot be ground.

For ultra precision grinding of brittle materials which attracts a great deal of attention recently, shape accuracy and surface roughness of the order of nanometers are aimed at. To accomplish the aims, a processing condition that the cutting depth of each abrasive grain is less than the critical cutting depth is required for processing. It is well known that when a brittle material is ground, it is processed in the brittle mode with cracks produced. However, it is found that by controlling the abrasive grain cutting depth to a minute value for processing, a brittle material can be processed in the ductile mode which produces no cracks in the same way as a metal. The boundary between the ductile mode and the brittle mode is referred to as a critical cutting depth (dc value), which is reported as about 0.1 μm, though it depends on the material. For that purpose, it is necessary to control the cutting edge condition of a grinding tool such that the grinding tool run out is reduced to the order of submicrons or less and the abrasive grain cutting edge height is constant.

FIG. 20 is a perspective view of a magnetic head and FIG. 21 is an enlarged drawing of the S section shown in FIG. 20.

The accuracy of magnetic heads is improved recently and particularly high shape accuracy and reduction in micro,step formed by processing are required. For finishing an air bearing surface of a magnetic head 4 which is opposite to a recording medium shown in FIG. 20, lapping is used at present. However, lapping is a processing method on the basis of the principle of pressure copying and hence the edge part under a high processing pressure is apt to be processed early. This causes the edges to be blunt and no high shape accuracy can be obtained. Since lapping uses free abrasive grains, a magnetic film 7 (Vickers hardness Hv=200) shown in FIG. 21 is low in hardness compared with a substrate 5 (Hv=1300) and a protection film 6 (Hv=1000) and hence is processed early and a micro step A' is formed by processing. If the air bearing surface of the magnetic head 4 can be processed by grinding which is a processing method on the basis of the principle of motion copying, it is possible to process the air bearing surface with high shape accuracy compared with lapping and to reduce the micro step formed by processing to 0 in principle. However, a problem imposed when lapping is replaced with grinding is that the processed surface roughness by grinding is worse than the processed surface roughness by lapping. Therefore, to process the magnetic head by grinding with high shape accuracy and good processed surface roughness, the diamond grinding tool requires the following points.

They are that diamond abrasive grains are bonded with metal bond with high holding stiffness, and the grinding tool run cut is controlled to the order of submicrons, and the abrasive grain cutting edge height is made constant.

The aforementioned conventional truing method is a so-called truing method founded on drop out of grain for removing the abrasive grain bond by truing and dropping out abrasive grains supported by this bond. However, according to this truing method, the hardness of abrasive grains which are a tool is lower than the hardness of diamond abrasive grains to be processed and hence the diamond abrasive grains cannot be ground. Therefore, the roundness of the trued diamond grinding tool is affected by the diamond abrasive grain distribution accuracy (an index indicating whether diamond abrasive grains are uniformly dispersed on the inner surface participating in processing of the grinding tool) on the peripheral surface of the grinding tool and the diamond abrasive grain size. As shown by A and B in FIG. 7, there is a problem that when the abrasive grain size of the grinding tool is large, the grinding tool run out increases. Furthermore, there is another problem that even when the abrasive grain size is small such as several μm, the grinding tool run out is rather large such as 1 μm and cannot be controlled to the order of submicrons.

As mentioned above, for ultra precision grinding of brittle materials such as ceramics, a processing condition that the cutting depth of each abrasive grain of the grinding tool is less than the critical cutting depth is required for processing. For that purpose, it is necessary to control the grinding tool run out to the order of submicrons or less and to make the abrasive grain cutting edge height constant. However, the conventional truing method does not take account of making the abrasive grain cutting edge height constant. Therefore, for a grinding tool trued by the conventional truing method, there is a problem that the processing condition that the cutting depth of each abrasive grain is less than the critical cutting depth and the ductile mode which produces no cracks in brittle materials cannot be applied to ultra precision grinding of brittle materials.

Furthermore, to grind the surface of a magnetic head which is opposite to a recording medium, it is necessary to process it with high shape accuracy and with processed surface roughness which is similar to the roughness by lapping. To grind the air bearing surface of the magnetic head with processed surface roughness which is similar to the roughness by lapping, it is necessary to form a diamond grinding tool by bonding diamond abrasive grains with metal bond with high holding stiffness, to control the diamond grinding tool run out, and to make the diamond abrasive grain cutting edge height constant. However, the conventional truing method gives no consideration to that a hard diamond grinding tool itself is ground and the diamond abrasive grain cutting edge height is made constant. Therefore, there is a problem that a diamond grinding tool trued by the conventional truing method cannot be applied to grinding the surface of a magnetic head which is opposite to a recording medium.

SUMMARY OF THE INVENTION

The first object of the present invention is to provide a grinding tool for minimizing the run out of the grinding surface and for making the cutting edge height of abrasive grains such as diamond abrasive grains precisely constant.

The second object of the present invention is to provide a grinding tool truing method for surely forming the above grinding tool.

The third object of the present invention is to provide a grinding tool truing apparatus for exactly executing the above grinding tool truing method.

Furthermore, the fourth object of the present invention is to provide a magnetic head wherein at least the surface which is opposite to a recording medium is finished by grinding with high shape accuracy and good processed surface roughness.

To accomplish the above objects, the present invention comprises a tool which has many abrasive grains secured with bond, a bond surface which is parallel with the grinding surface of the above tool, and many abrasive grains with a flat sectional shape which are projected from the bond surface almost by a predetermined distance so that the surfaces parallel with the bond surface are flat and embedded in the above bond surface.

Furthermore, according to the present invention, the grinding surface of a grinding tool which has many abrasive grains secured with bond is trued, and the bond surface of the grinding surface which is trued is uniformly dressed go as to project many abrasive grains in the above grinding surface from the above bond surface almost by a predetermined distance, and the tips of the many projected abrasive grains are lapped in parallel with the above grinding surface so as to process the above many abrasive grains in a shape with almost a flat section.

Next, this will be described concretely using typical examples.

The above first object is accomplished, in the case of a diamond grinding tool which is formed in a disc shape, by circularly grinding the grinding surface of the above grinding tool, and projecting the above abrasive grains from the bond surface by a predetermined distance, and forming the tips of the projected abrasive grains almost flat.

Furthermore, the above first object is accomplished, in the case of a diamond grinding tool which is formed in a cup shape, by grinding the grinding surface of the above grinding tool to a highly accurate flat surface, and projecting the above abrasive grains from the bond surface by a predetermined distance, and forming the tips of the projected abrasive grains almost flat.

The above second object is accomplished, in the case of a disc-shaped diamond grinding tool, by using the above diamond grinding tool as a workpiece and the diamond tool as a truing tool, and circularly grinding the peripheral surface of the workpiece which is the grinding surface of the above diamond grinding tool by the truing tool, and uniformly dressing the above bond surface, and projecting diamond abrasive grains of the workpiece from the bond surface by a predetermined distance, and grinding the tip of each diamond abrasive grain which is projected from the above bond surface almost flat by the truing tool.

Furthermore, the above second object is accomplished, in the case of a cup-shaped diamond grinding tool, by using the above diamond grinding tool as a workpiece and the diamond tool as a truing tool, and grinding the end face of the workpiece which is the grinding surface of the above diamond grinding tool to a highly accurate flat surface by the truing tool, and uniformly dressing the above bond surface, and projecting diamond abrasive grains of the workpiece from the bond surface by a predetermined distance, and grinding the tip of each diamond abrasive grain which is projected from the above bond surface almost flat by the truing tool.

Furthermore, the above second object is also accomplished, in the case of a diamond grinding tool wherein the above diamond abrasive grains are secured with metal bond, by arranging an electrode opposite to the grinding surface of the diamond grinding tool which is a workpiece at a predetermined interval, and connecting the anode of power source to the above workpiece and the cathode of power source to the above electrode, and supplying an electric current to the above workpiece and electrode, and rotating the workpiece so as to uniformly dress the above metal bond surface electrochemically.

Furthermore, the above second object is accomplished more satisfactorily by using a plate made with iron group metal as a truing tool for lapping the tip of each diamond abrasive grain projected from the bond surface and rotating the above workpiece and plate so as to lap the tips of diamond abrasive grains with the above plate.

The above third object is accomplished by arranging a first truing apparatus, a dressing apparatus, and a second truing apparatus, wherein the above first truing apparatus comprises a spindle which is supported by a bearing with static pressure and supports a diamond grinding tool which has many diamond abrasive grains secured with bond as a workpiece, a rotation drive source for this spindle, a first truing tool for grinding the grinding surface of the diamond grinding tool which is the workpiece, a rotation drive source for this first truing tool, and a cutting means for feeding the above first truing tool and diamond grinding tool which is the workpiece relatively in the cutting direction, and the above dressing apparatus is structured so as to project the diamond abrasive grains by a predetermined distance by uniformly removing the above bond surface, and the above second truing apparatus comprises a spindle which is supported by a bearing with static pressure and supports a dressed diamond grinding tool as a workpiece, a rotation drive source for this spindle, a second truing tool for lapping the tip of each diamond abrasive grain which is projected from the above bond surface so as to align the cutting edges, a rotation drive source for this second truing tool, and a cutting means for feeding the above second truing tool and diamond grinding tool which is the workpiece relatively in the cutting direction. Furthermore, the above third object is also accomplished by attaching the above first truing tool and second truing tool selectively to a single truing apparatus and using the single truing apparatus as the above first truing apparatus and second truing apparatus.

Furthermore, the above third object is accomplished more satisfactorily by fixing the position of the above spindle for supporting a diamond grinding tool which is a workpiece and structuring the above first truing tool, dressing apparatus, and second truing tool so that each of them can move to the processing position and escaping position for the workpiece.

Furthermore, the above third object is accomplished more satisfactorily by using a cup-shaped metal bond diamond tool as a first truing tool and furthermore using a cup-shaped plate made with iron group metal as a second truing tool, and structuring the above dressing apparatus for a diamond grinding tool which has diamond abrasive grains secured by metal bond so that it comprises an electrode arranged opposite to the above diamond grinding tool at a predetermined interval, a power source wherein the anode is connected to the diamond grinding tool which is a workpiece and the cathode is connected to the above electrode, and a rotation drive source for the above diamond grinding tool.

The above fourth object is accomplished by finishing at least the surface which is opposite to a recording medium by grinding.

Next, the operation of the present invention will be concretely described.

When a disc-shaped diamond grinding tool of the present invention is used, the peripheral surface of this grinding tool is ground circularly and diamond abrasive grains are projected from the bond surface by a predetermined distance. Furthermore, the tips of the diamond abrasive grains projected from the bond surface are formed almost flat.

Since the peripheral surface of a diamond grinding tool is ground circularly like this, the run out of the diamond grinding tool can be controlled to the order of submicrons during grinding. Furthermore, since the tips of diamond abrasive grains projected from the bond surface are formed almost flat, the diamond abrasive grain cutting edge height can be made precisely constant. Therefore, the diamond grinding tool in this case can be applied to ultra precision grinding of brittle materials or to finishing of the surface of a magnetic head which is opposite to a recording medium by grinding.

Next, when a cup-shaped diamond grinding tool of the present invention is used, the end face which is the grinding surface of this grinding tool is ground to a highly accurate flat surface. Furthermore, in the same way as with the above circular diamond grinding tool, diamond abrasive grains are projected from the bond surface by a predetermined distance and the tips of the diamond abrasive grains projected from the bond surface are formed almost flat.

As mentioned above, since the grinding surface of a diamond grinding tool is ground to a highly accurate flat surface, the run out of the grinding surface of the diamond grinding tool can be controlled to the order of submicrons during grinding. Furthermore, since the tips of diamond abrasive grains projected from the bond surface are formed almost flat, the diamond abrasive grain cutting edge height can be made constant. Therefore, the diamond grinding tool in this case can be also applied to ultra precision grinding of brittle materials or to finishing of the surface of a magnetic head which is opposite to a recording medium by grinding.

Next, a case that a disc-formed diamond grinding tool of the present invention is used as a workpiece, and a diamond tool is used as a truing tool, and the above workpiece is ground circularly by the truing tool will be described. The bond surface of the diamond grinding tool, that is, the circular surface is uniformly dressed further so as to project diamond abrasive grains from the bond surface by a predetermined distance. Then, the tip of each diamond abrasive grain protected from the above bond surface is lapped almost flat by the truing tool.

According to this truing method, a diamond grinding tool which is a workpiece is ground by a diamond tool which is a truing tool and hence the height distribution accuracy of diamond abrasive grains can be improved and the effect of the abrasive grain size of the grinding tool on the run out of the grinding tool can be minimized. Therefore, the run out of the diamond grinding tool can be controlled to the order of submicrons. Furthermore, since the tip of each diamond abrasive grain projected from the bond surface is lapped by the truing tool, the abrasive grain cutting edge height can be made precisely constant. Therefore, the diamond grinding tool can be trued so that the effect of the abrasive grain size on the processed surface roughness of the grinding tool can be minimized.

Next, a case that a cup-shaped diamond grinding tool of the present invention is used as a workpiece, and a diamond tool is used as a truing tool., and the end face of the workpiece which is the grinding surface of the diamond grinding tool is ground to a highly accurate flat surface by the truing tool will be described. In the same way as with the above disc shape, the bond surface is uniformly dressed so as to project diamond abrasive grains of the workpiece from the bond surface by a predetermined distance. Then, the tip of each diamond abrasive grain projected from the above bond surface is lapped.

By doing this, also in this case, the run out of the grinding surface of the diamond grinding tool can be controlled to the order of submicrons and the diamond grinding tool can be trued so that the abrasive grain cutting edge height can be made precisely constant and the effect of the abrasive grain size on the processed surface roughness of the grinding tool can be minimized.

Furthermore, for a diamond grinding tool of the present invention which has diamond abrasive grains secured with metal bond, the metal bond surface is uniformly dressed electrochemically.

As a result, even when metal bond with high holding stiffness is used as bond, it is possible to electrolyze the metal bond, to uniformly remove the bond surface without breaking the diamond abrasive grain cutting edge condition, and to easily project the abrasive grain cutting edges which are tips of the diamond abrasive grains from the bond surface.

Furthermore, it is extremely effective that a plate made with iron group metal is used as a truing tool of the present invention for lapping the tips of diamond abrasive grains projected from the bond surface. The diamond grinding tool which is the workpiece and the plate which is the truing tool are rotated so as to contact with each other and the tips of the diamond abrasive grains are lapped with the plate. When the diamond and iron are lapped with each other, a chemical reaction that carbon contained in the diamond is absorbed into the iron is produced.

In this case, therefore, using the chemical reaction that carbon contained in the diamond is absorbed into the iron, the tips of the hard diamond abrasive grains of the diamond grinding tool are lapped with the plate so as to wear out little by little and the diamond abrasive grain cutting edge height can be made constant surely and highly accurately.

According to another configuration of the present invention, a first truing apparatus, dressing apparatus, and second truing apparatus are arranged.

The above first truing apparatus comprises a spindle which is supported by a bearing with static pressure, a rotation drive source for this spindle, a first truing tool for grinding the grinding surface of a diamond grinding tool which is a workpiece, a rotation drive source for this first truing tool, and a cutting means for feeding the above first truing tool and diamond grinding tool which is the workpiece relatively in the cutting direction. The diamond grinding tool which is the workpiece is attached to the spindle of this first truing apparatus and the spindle and first truing tool are rotated by the independent rotation drive sources. Next, the diamond grinding tool or the first truing tool is fed gradually in the cutting direction for the grinding surface of the diamond grinding tool via the cutting means. By doing this, the peripheral surface which is the grinding surface when the workpiece is a disc-shaped diamond grinding tool or the end face which is the grinding surface when the workpiece is a cup-shaped diamond grinding tool can be ground gradually by the first truing tool. When the grinding surface of the diamond grinding tool is ground by the first truing tool, the spindle does not run away in the opposite direction of the cutting direction because it is supported powerfully by the bearing with static pressure. Furthermore, since the diamond grinding tool which is the workpiece is directly rotated by the spindle and the rotation drive source thereof and the first truing tool is directly rotated by the rotation drive source thereof, even if the diamond grinding tool and the first truing tool come into contact with each other with friction, the two rotate in predetermined directions thereof with high accuracy. Therefore, the part projected from the grinding surface of the diamond grinding tool can be surely ground by the first truing tool. When the workpiece is a disc-shaped diamond grinding tool, the disc-shaped diamond grinding tool can be formed circularly and precisely. When the workpiece is a cup-shaped diamond grinding tool, the end face which is the grinding surface can be formed to a highly accurate flat surface.

Next, the diamond grinding tool formed by the above first truing apparatus is attached to the dressing apparatus. Using this dressing apparatus, the bond surface is uniformly removed and diamond abrasive grains are projected from the bond surface by a predetermined distance.

Next, the above second truing apparatus comprises a spindle which is supported by a bearing with static pressure, a rotation drive source for this spindle, a second truing tool for lapping the tips of diamond abrasive grains which are projected from the bond surface, a rotation drive source for this second truing tool, and a cutting means for feeding the above second truing tool and diamond grinding tool which is the workpiece relatively in the cutting direction. The diamond grinding tool which is dressed by the above dressing apparatus is attached to the spindle of this second truing apparatus as a workpiece. Then, the spindle and second truing tool are rotated by the independent rotation drive sources. Next, the diamond grinding tool or the second truing tool is fed gradually in the, cutting direction for the grinding surface of the diamond grinding tool via the cutting means. By doing this, the tips of the diamond abrasive grains projected from the bond surface are lapped slowly by the second truing tool starting with the tip which is projected most and the tip of each diamond abrasive grain is lapped almost flat. Also in this second truing apparatus, the spindle does not run away in the opposite direction of the cutting direction because it is supported powerfully by the bearing with static pressure during lapping. Furthermore, since the diamond grinding tool which is the workpiece is directly rotated by the spindle and the rotation drive source thereof and the second truing tool is directly rotated by the rotation drive source thereof, even if the diamond grinding tool and the second truing tool come into contact with each other with friction, the two rotate in predetermined directions thereof with high accuracy and the tips of the diamond abrasive grains projected from the bond surface can be ground surely and accurately by the second truing tool and hence the diamond abrasive grain cutting edge height can be made constant accurately.

Therefore, this configuration allows the above truing method of the present invention to be executed precisely.

According to a further configuration of the present invention, a first truing tool and second truing tool are selectively attached to a single truing apparatus and the single truing apparatus serves as the above first truing apparatus and second truing apparatus.

By doing this, the cost of equipment can be cut down and the installation space of equipment can be narrowed.

According to another configuration of the present invention, the position of the spindle for supporting a workpiece is fixed and the above first truing tool, dressing apparatus, and second truing tool can be moved to the processing position and escaping position for the workpiece. A diamond grinding tool which is the workpiece is attached to the spindle, and the first truing tool is moved to the processing position so as to grind the grinding surface of the diamond grinding tool and then moved to the escaping position after the target grinding is finished. Next, the truing apparatus is moved to the processing position so as to true the bond surface of the diamond grinding tool and then moved to the escaping position after the target lapping is finished.

According to this configuration, grinding of the grinding surface of the diamond grinding tool, dressing of the bond surface, and lapping of the tip of each diamond abrasive grain projected from the bond surface are performed one by one with the diamond grinding tool, which is the workpiece, attached to the spindle. Therefore, the workpiece attaching error can be eliminated and hence workpieces can be processed with extremely high accuracy. Furthermore, the above processing can be performed continuously and hence the operation efficiency, can be increased.

In another modified example, a cup-shaped metal bond diamond tool is used as a first truing tool or a cup-shaped plate made with iron group metal is used as a second truing tool.

By doing this, the aforementioned diamond grinding tool which is a hard workpiece can be trued precisely.

In a further modified example, in a diamond grinding tool which has diamond abrasive grains secured with metal bond, a dressing apparatus comprises an electrode which is arranged opposite to the diamond grinding tool which is a workpiece at a predetermined distance, a power source wherein the anode is connected to the diamond grinding tool which is the workpiece and the cathode is connected to the electrode, and a rotation drive source for the above diamond grinding tool.

In this case, therefore, even when metal bond with high holding stiffness is used as bond, the tips of diamond abrasive grains can be easily projected from the bond surface by the aforementioned operation.

Furthermore, according to the present invention, by a diamond tool which is trued in this way, at least the surface of a magnetic head which is opposite to a recording medium is ground.

By doing this, the surface which is opposite to a recording medium can be finished by grinding with high shape accuracy by making the best use of the grinding characteristics and the finishing by grinding can be performed efficiently.

The foregoing and other objects, advantages, manner of operation and novel features of the present invention will be understood from the following detailed description when read in connection with the accompanying drawings.

DETAILED DESCRIPTION OF THE PREFERRED EMBODIMENTS

The embodiments of the present invention will be described hereunder with reference to the accompanying drawings.

Figure 1A:
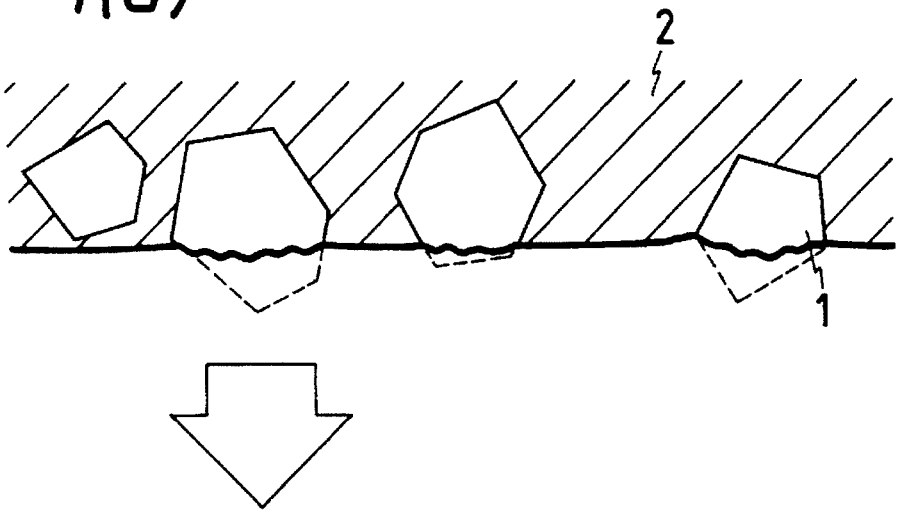
FIG. 1 shows an embodiment of the truing method of the present invention, FIG. 1(*a*) shows the processing type truing process for the peripheral surface of a diamond grinding tool, and FIG. 1(*b*) shows the bond dressing process for a diamond grinding tool, and FIG. 1(*c*) shows the lapping type truing process for diamond abrasive grains projected from the bond.
Figure 1B:
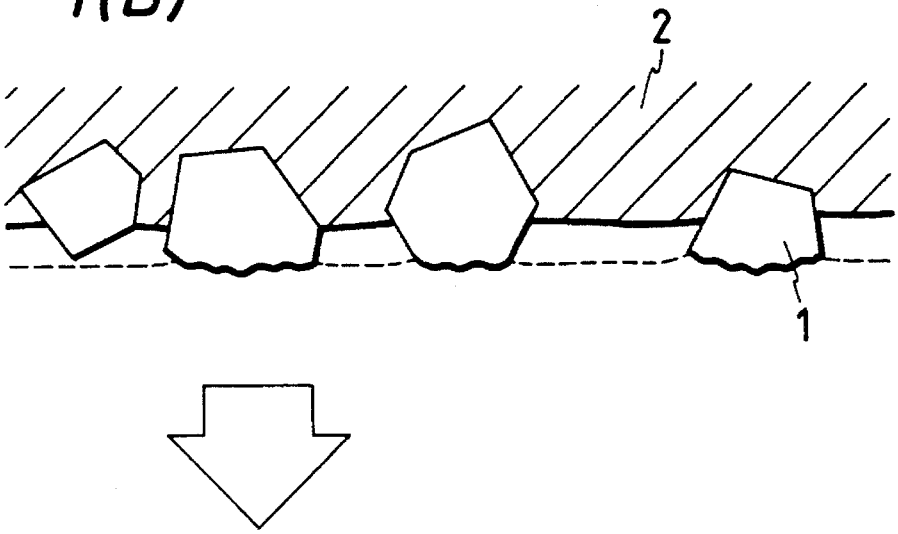
Figure 1C:
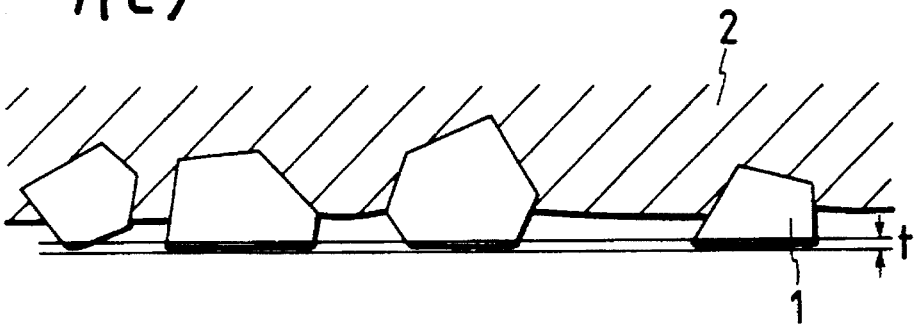
Figure 2:
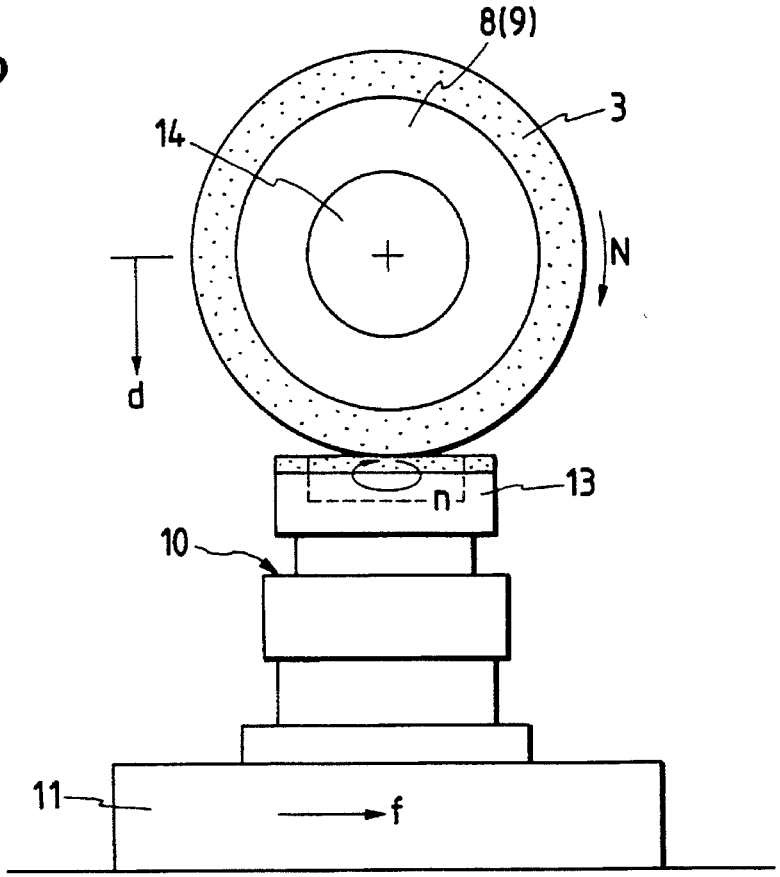
FIG. 2 is a front view of the first truing apparatus of the truing apparatus of the present invention.
Figure 3:
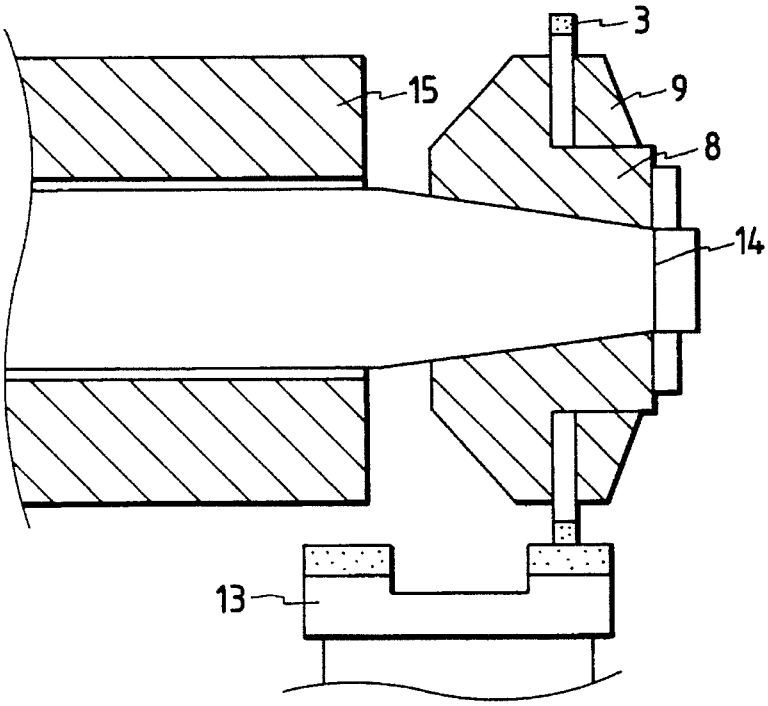
FIG. 3 is a central vertical side view of FIG. 2.
Figure 4:
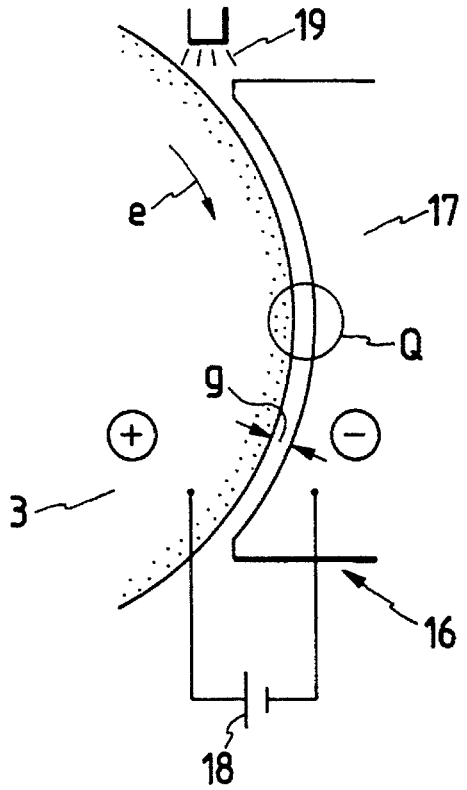
FIG. 4 is a conceptual diagram of the electro chemical dressing apparatus of the truing apparatus of the present invention.
Figure 5:
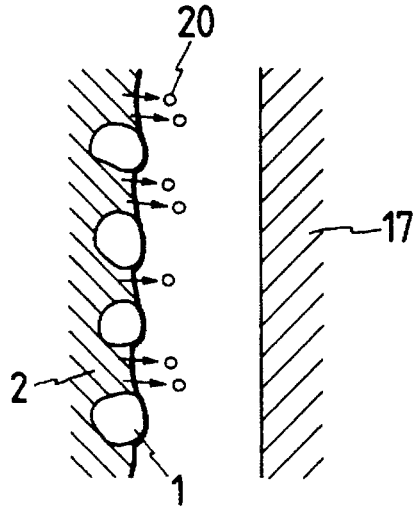
FIG. 5 is an enlarged view of the section Q shown in FIG. 4.
Figure 6:
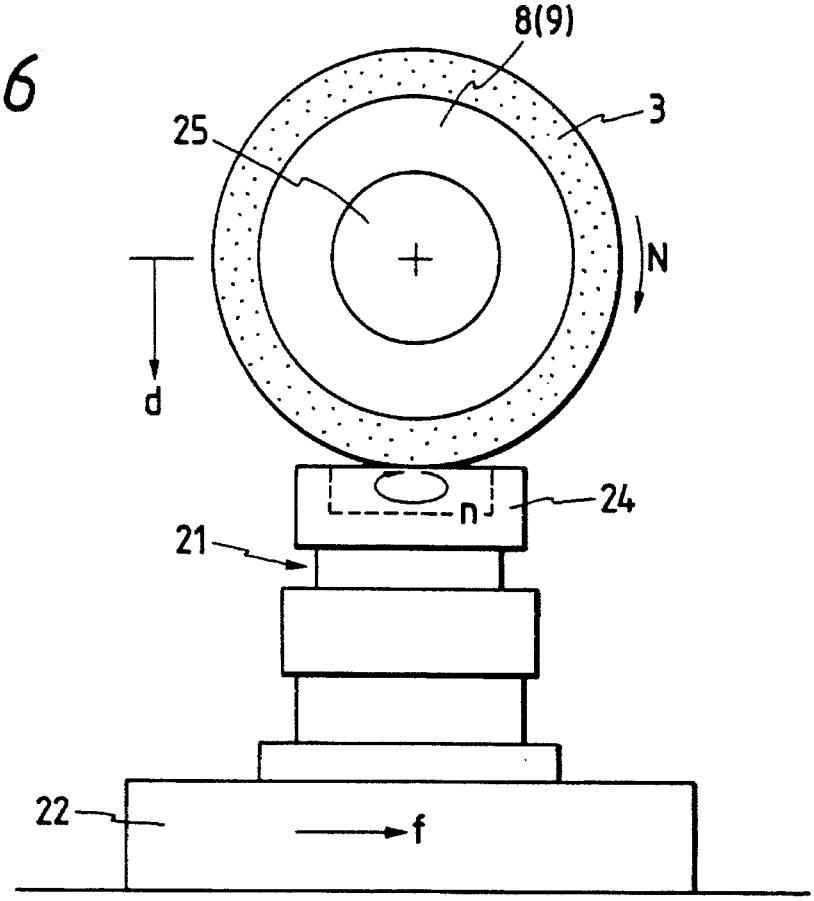
FIG. 6 is a front view of the second truing apparatus of the truing apparatus of the present invention.

FIGS. 1 to 6 show an embodiment of the present invention. FIGS. 1(*a*), 1(*b*), and 1(*c*) are conceptual diagrams of the truing method of the present invention, FIG. 2 is a front view of the first truing apparatus of the truing apparatus of the present invention, FIG. 3 is a central vertical side view of FIG. 2, FIG. 4 is a conceptual diagram of the electro chemical dressing apparatus of the truing apparatus, FIG. 5 is an enlarged view of the section Q shown in FIG. 4 and an illustration for the operation of the electro chemical dressing apparatus, and FIG. 6 is a front view of the second truing apparatus of the truing apparatus.

In the embodiment shown in these drawings, the truing apparatus comprises, as shown in FIGS. 2 to 6, a first truing apparatus 10, a dressing apparatus, and a second truing apparatus 21. The workpiece in this embodiment is a diamond grinding tool 3 which is formed in a disc form with diamond abrasive grains secured with metal bond.

The above first truing apparatus 10 comprises a feed table 11, a tool support, a first truing tool 13, a rotation drive source thereof (not shown in the drawing), a spindle 14, a bearing with static pressure 15 supporting this spindle 14, a rotation drive source (not shown in the drawing) of the above spindle 14, a cutting means (neither shown in the drawing) for feeding a diamond grinding tool 3 via the spindle 14, and a grinding fluid feed means (neither shown in the drawing).

The above feed table 11 moves the first truing tool 13 in the direction of the arrow shown in FIG. 2 via the tool support during truing and the feed rate is indicated by a symbol f.

The above first truing tool 13 is a cup-shaped diamond tool. The first truing tool 13 is arranged at right angles to the spindle 14and supported by the tool support 12. The first truing tool 13 is rotated directly in the direction of the arrow shown in FIG. 2 by the rotation drive source thereof and the number of revolutions is indicated by a symbol n.

The diamond grinding tool 3 which is a workpiece is loaded into the spindle 14 via a flange 8 and secured by a clamp 9 as shown in FIG. 3. Furthermore, the spindle 14 is supported by the bearing with static pressure 15 and rotated directly in the direction of the arrow shown in FIG. 2 by the rotation drive source thereof and the number of revolutions is indicated by a symbol N.

The above bearing with static pressure 15 is a bearing with static pressure air or a bearing with static pressure oil.

The above cutting means feeds the diamond grinding tool 3 gradually in the radial direction of the disc-shaped diamond grinding tool 3 which is the workpiece in the direction of the arrow shown in FIG. 2 via the spindle 14 during truing and one-cutting depth is indicated by a symbol d.

The above grinding fluid feed means is arranged so as to feed grinding fluid between the first truing tool 13 and the diamond grinding tool 3 which is the workpiece.

The above dressing apparatus is an electro chemical dressing apparatus 16 in this embodiment. This electro chemical dressing apparatus 16 comprises, as shown in FIG. 4, an electrode 17, a DC power source 18, a means for feeding grinding fluid 19, and a rotation drive source (not shown in the drawing) of the diamond grinding tool 3 which is the workpiece.

The above electrode 17 is arranged at a predetermined interval g between the electrode and the peripheral surface of the diamond grinding tool 3 which is the workpiece.

The above DC power source 18 comprises an anode connected to the diamond grinding tool 3 and a cathode connected to the electrode 17.

The above grinding fluid 19 is fed into the gap between the diamond grinding tool 3 and the electrode 17.

The above rotation drive source rotates the diamond grinding tool 3 in the direction of the arrow e shown in FIG. 4 during dressing.

When the DC power source 18 supplies an electric current to the diamond grinding tool 3 and the electrode 17, the metal bond of diamond abrasive grains is electrolyzed into metallic ions by the electro chemical dressing apparatus 16 and removed as shown in FIG. 5.

The above second truing apparatus 21 comprises, as shown in FIG. 6, a feed table 22, a tool support, a second truing tool 24, a rotation drive source (not shown in the drawing) thereof, a spindle 25, a bearing with static pressure (not shown in the drawing) supporting this spindle 25, a rotation drive source (not shown in the drawing) of the above spindle 25, and a cutting means (neither shown in the drawing) for feeding a diamond grinding tool 3 via the spindle 25.

The above feed table 22 moves the second truing tool 24 in the direction of the arrow shown in FIG. 6 via the tool support 23 during truing and the feed rate is indicated by a symbol f.

The above second truing tool 24 is a cup-shaped plate made of cast iron which is iron group metal. The second truing tool 24 is arranged at right angles to the spindle 25 and supported by the tool support 23. The above second truing tool 24 is rotated directly in the direction of the arrow shown in FIG. 6 by the rotation drive source thereof and the number of revolutions is indicated by a symbol n.

The diamond grinding tool 3 which is dressed by the above dressing apparatus is loaded into the spindle 25 as a workpiece via a flange 8 and secured by a clamp 9. Furthermore, the spindle 25 is supported by the bearing with static pressure and rotated directly in the direction of the arrow shown in FIG. 6 by the rotation drive source thereof and the number of revolutions is indicated by a symbol N.

The above bearing with static pressure is the same as the bearing with static pressure 15 of the spindle 14 of the first truing apparatus 10.

The above cutting means feeds the diamond grinding tool 3 gradually in the radial direction of the diamond grinding tool 3 which is the workpiece in the direction of the arrow shown in FIG. 6 via the spindle 25 during truing and onecutting depth is indicated by a symbol d.

Next, in association with the operation of the truing apparatus of the above embodiment, the truing method of the present invention and the diamond grinding tool which is a product thereof will be explained.

Firstly, the diamond grinding tool 3, which is a workpiece formed in a disc shape by securing diamond abrasive grains with metal bond, is loaded into the spindle 14 of the first truing apparatus 10 of the truing apparatus shown in FIGS. 2 and 3 via the flange 8 and fixed by the clamp 9.

Next, the first truing tool 13 is rotated in the direction of the arrow shown in FIG. 2 and the diamond grinding tool 3 is rotated in the direction of the arrow shown in FIG. 2 via the spindle 14. The diamond grinding tool 3 is fed in the direction of the arrow shown in FIG. 2 by the cutting means via the spindle 14 and is set so that the most projected part of the peripheral surface of the diamond grinding tool 3 comes in contact with the top of the first truing tool 13. Then, grinding fluid is fed between the first truing tool 13 and the diamond grinding tool 3 by the grinding fluid feed means. Next, the diamond grinding tool 3 is automatically fed gradually in the,above direction of the arrow by the above cutting means. Furthermore, the feed table 11 is moved little by little in the direction of the arrow shown in FIG. 2.

By doing this, the peripheral surface of the diamond grinding tool 3 which is a workpiece is ground by the first truing tool 13 which is a diamond tool. In this case, the diamond abrasive grains 1 of the diamond grinding tool 3 are also ground as shown in FIG. 1(*a*) and the entire diamond grinding tool 3 is ground circularly by a so-called processing type truing method.

When the above diamond grinding tool 3 is ground, the spindle 14 does not run away in the opposite direction of the cutting direction of the diamond grinding tool 3 because it is supported powerfully by the bearing with static pressure 15. Furthermore, since the diamond grinding tool 3 is directly rotated by the spindle 14 and the rotation drive source thereof (not shown in the drawing) and the first truing tool 13 is directly rotated by the rotation drive source thereof (not shown in the drawing), even if the diamond grinding tool 3 and the first truing tool 13 come into contact with each other with friction, the two rotate in predetermined directions thereof with high accuracy. Therefore, the part projected from the peripheral surface of the diamond grinding tool 3 can be surely ground by the first truing tool 13. As a result, the diamond grinding tool 3 can be formed circularly and surely.

As mentioned above, after the diamond grinding tool 3 is ground circularly by the processing type truing method, the function of each part of the first truing apparatus 10 is stopped, and the processed diamond grinding tool 3 is removed from the spindle 14, and each part of the first truing apparatus 10 is returned to the initial state.

Next, the above ground diamond grinding tool 3 is shown in FIG. 4. Furthermore, the electrode 17 is attached to the electro chemical dressing apparatus 16 arranged at a predetermined interval g shown in FIG. 4 between the dressing apparatus and the above diamond grinding tool 3 which is the workpiece, and the anode of the DC power source 18 is connected to the diamond grinding tool 3 and the cathode is connected to the electrode 17, and then an electric current is supplied to them.

Then, grinding fluid 19 is fed between the above diamond grinding tool 3 and the electrode 17 and the diamond grinding tool 3 is rotated in the direction of the arrow e shown in FIG. 4 by the rotation drive source (not shown in the drawing).

By doing this, metal bond 2 of the diamond grinding tool 3 is electrolyzed into metallic ions 20 and the ions are uniformly removed from the surface of the metal bond 2 as shown in FIG. 5. Therefore, the metal bond 2 can be easily removed by this electro chemical dressing without the cutting edge condition of the diamond abrasive grains 1 being broken and the cutting edges which are the tips of the diamond abrasive grains 1 can be projected from the surface of the metal bond 2 as shown in FIG. 1(*b*).

After the above diamond grinding tool 3 is dressed, the function of each part of the electro chemical dressing apparatus 16 is stopped, and the diamond grinding tool 3 is removed from the electro chemical dressing apparatus 16, and the electro chemical dressing apparatus 16 is returned to the initial state.

Next, the above dressed diamond grinding tool 3 is loaded in the spindle 25 of the second truing apparatus 21 shown in FIG. 4 as a workpiece via the flange 8 and secured by the clamp 9.

Next, the second truing tool 24 is rotated in the direction of the arrow shown in FIG. 6 and the diamond grinding tool 3 is rotated in the direction of the arrow via the spindle 25. The diamond grinding tool 3 is fed in the direction of the arrow shown in FIG. 6 by the cutting means via the spindle 25 and is set so that the peripheral surface of the diamond grinding tool 3 comes in contact with the top of the second truing tool 24. Then, the diamond grinding tool 3 is automatically fed gradually in the above direction of the arrow by the above cutting means and furthermore the feed table 22 is moved little by little in the direction of the arrow shown in FIG. 6.

By doing this, the diamond grinding tool 3 which is a workpiece comes into contact with the second truing tool 24 which is a plate made with cast iron, and the diamond abrasive grains 1 of the diamond grinding tool 3 are lapped with the above second truing tool 24, and the tip of each diamond abrasive grain 1 projected from the peripheral surface of the metal bond 2 by a so-called lapping type truing method is lapped. When the plate made of cast iron is lapped with the diamond, by a chemical reaction between iron and diamond that the iron absorbs carbon contained in the diamond, the tip of each diamond abrasive grain 1 is removed little by little.

By this second truing apparatus 21, using the chemical reaction of iron and diamond as mentioned above, the cutting edge height of the diamond abrasive grains 1 can be made constant surely and highly accurately by the lapping type truing method that the tip of each diamond abrasive grain 1 is lapped by the second truing tool 24 as shown in FIG. 1(*c*).

When the above diamond grinding tool 3 is ground, the spindle 25 does not run away in the opposite direction of the cutting direction of the diamond grinding tool 3 because it is supported powerfully by a bearing with static pressure (not shown in the drawing). Furthermore, since the diamond grinding tool 3 is directly rotated by the spindle 25 and the rotation drive source thereof (not shown in the drawing) and the second truing tool 24 is directly rotated by the rotation drive source thereof (not shown in the drawing), even if the diamond grinding tool 3 and the second truing tool 24 come into contact with each other with friction, the two rotate in predetermined directions thereof with high accuracy. Therefore, the tip of each diamond abrasive grain 1 projected from the peripheral surface of the metal bond 2 can be surely ground by the second truing tool 24. As a result, the cutting edge height of each diamond abrasive grain 1 projected from the peripheral surface of the metal bond 2 can be made constant accurately.

As mentioned above, after the cutting edge height of the diamond abrasive grains 1 of the diamond grinding tool 3 is made constant, the function of each part of the second truing apparatus 21 is stopped, and the diamond grinding tool 3 which is a product is removed from the spindle 25, and each part of the second truing apparatus 21 is returned to the initial state, and one stroke of truing of the diamond grinding tool 3 is finished.

The disc-shaped diamond grinding tool 3 which is a product formed by the above truing process is formed circularly by the processing type truing method and hence the tool run out is controlled to the order of submicrons. Even if hard metal bond 2 is used, the tips of diamond abrasive grains 1 can be projected by a predetermined distance by the electro chemical dressing method. Furthermore, the tip of each diamond abrasive grain 1 projected from the above metal bond 2 is lapped by the lapping type truing method, and the cutting edge height is made constant accurately, and the cutting edges are formed almost flat so that good processed surface roughness is obtained. Therefore, the diamond grinding tool 3 which is a product can be applied immediately to processing of brittle materials in the ductile mode or to finishing of the surface of the magnetic head 4 shown in FIG. 20, which is opposite to a recording medium, by grinding.

Figure 14:
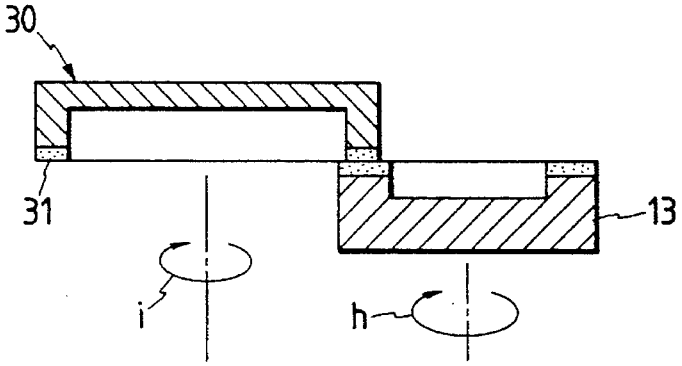
FIG. 14 is an illustration for the truing method of the present invention for a cup-shaped diamond grinding tool.

Next. FIG. 14 is an illustration for the truing method of the present invention for a cup-shaped diamond grinding tool.

When a cup-shaped diamond grinding tool is trued by the truing method of the present invention, an end face 31 which is the grinding surface of a diamond grinding tool 30 is ground to a highly accurate flat surface first, and the bond surface of the end face 31 is dressed next, and then the tip of each diamond abrasive grain projected from the bond surface of the end face 31 is lapped.

To grind the end face 31 of the diamond grinding tool 30, which is a workpiece, first, a truing apparatus, which supports the spindle 14 of the first truing apparatus 10 of the embodiment shown in FIG. 2 vertically, is used. In the embodiment shown in FIG. 14, the diamond grinding tool 30 is attached to the spindle (not shown in the drawing) so that the end face 31 to be trued is set with the bottom up and eccentric to the shaft center of the first truing tool 13. Furthermore, a diamond tool having a abrasive grain size which is larger than the diamond abrasive grain size of the diamond grinding tool 30 which is a workpiece is used as a first truing tool 13.

Then, by rotating the diamond grinding tool 30 in the direction of the arrow i via the spindle and rotation drive source thereof (both are not shown in the drawing) and the first truing tool 13 in the direction of the arrow h via the rotation drive source thereof (not shown in the drawing), the most projected part of the end face 31 of the diamond grinding tool 30 is allowed to come into contact with the top of the first truing tool 13. In this case, the peripheral speed of the first truing tool 13 is made faster than the peripheral speed of the diamond grinding toll 30. Furthermore, after the end face 31 of the diamond grinding tool 30 is allowed to come into contact with the top of the first truing tool 13, the diamond grinding tool 30 is automatically cut and fed little by little so as to grind the end face 31 of the diamond grinding tool 30 to a highly accurate flat surface.

Next, the bond surface of the diamond grinding tool 30 wherein the end face 31 is ground to a highly accurate flat surface is uniformly removed by the dressing apparatus (not shown in the drawing) so as to project the tips of diamond abrasive grains from the bond surface by a predetermined distance. When the above bond is metal bond, by using,the electro chemical dressing apparatus 16 shown in FIG. 4, the metal bond surface can be removed uniformly and easily by electrolysis.

Then, to lap the tip of each diamond abrasive grain projected from the bond surface by dressing, a truing apparatus, which supports the spindle 25 of the second truing apparatus 21 of the embodiment shown in FIG. 6 vertically, is used. Furthermore, a cup-shaped plate made of cast iron is used as a second truing tool 24 as shown in FIG. 6. The diamond grinding tool 30 which is a workpiece is attached to the above spindle so that the end face 31 to be trued is set with the bottom up and eccentric to the shaft center of the second truing tool 24. Then, the diamond grinding tool 30 is rotated via the spindle and rotation drive source thereof (both are not shown in the drawing), and the second truing tool 24 is rotated at a peripheral speed which is faster than the peripheral speed of the diamond grinding tool 30 via the rotation drive source thereof (not shown in the drawing), and diamond abrasive grains which are projected most among many diamond abrasive grains are allowed to come into contact with the top of the second truing tool 24, and the diamond grinding tool 30 is automatically cut and fed so as to grind the tip of each diamond abrasive grain and to make the diamond abrasive grain cutting edge height accurately constant.

By the above process, the end face 31 of the cup-shaped diamond grinding tool 30 which is the grinding surface thereof can be also trued as shown in FIGS. 1(*a*), 1(*b*), and 1(*c*). Therefore, it is possible to true a cup-shaped diamond grinding tool so that the run out of the end face which is a grinding surface is controlled to the order of submicrons and good processed surface roughness is obtained when it is used.

Figure 15:
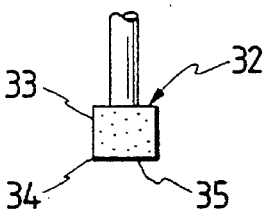
FIG. 15 is an illustration for the truing method of the present invention for a diamond grinding tool mounted on a spindle.

Next, FIG. 15 is an illustration for the truing method of the present invention for a diamond grinding tool mounted on a spindle.

When a peripheral surface 33 or a ring edge 34 is trued by the truing method of the present invention as a grinding surface of the diamond grinding tool mounted on a spindle 32 shown in FIG. 15 as a truing method for a diamond grinding tool mounted on a spindle, the process which is the same as that for the aforementioned disc-shaped diamond grinding tool 3 is used. Furthermore, when an end face 35 is trued by the truing method of the present invention as a grinding surface of the diamond grinding tool mounted on a spindle 32, the process which is the same as that for the aforementioned cup-shaped diamond grinding tool 30 is used. By doing this, the peripheral surface 33, the ring edge 34, or the end face 35 which is the grinding surface of the diamond grinding tool mounted on a spindle 32 can be trued as shown in FIGS. 1(*a*), 1(*b*), and 1(*c*).

Figure 16:
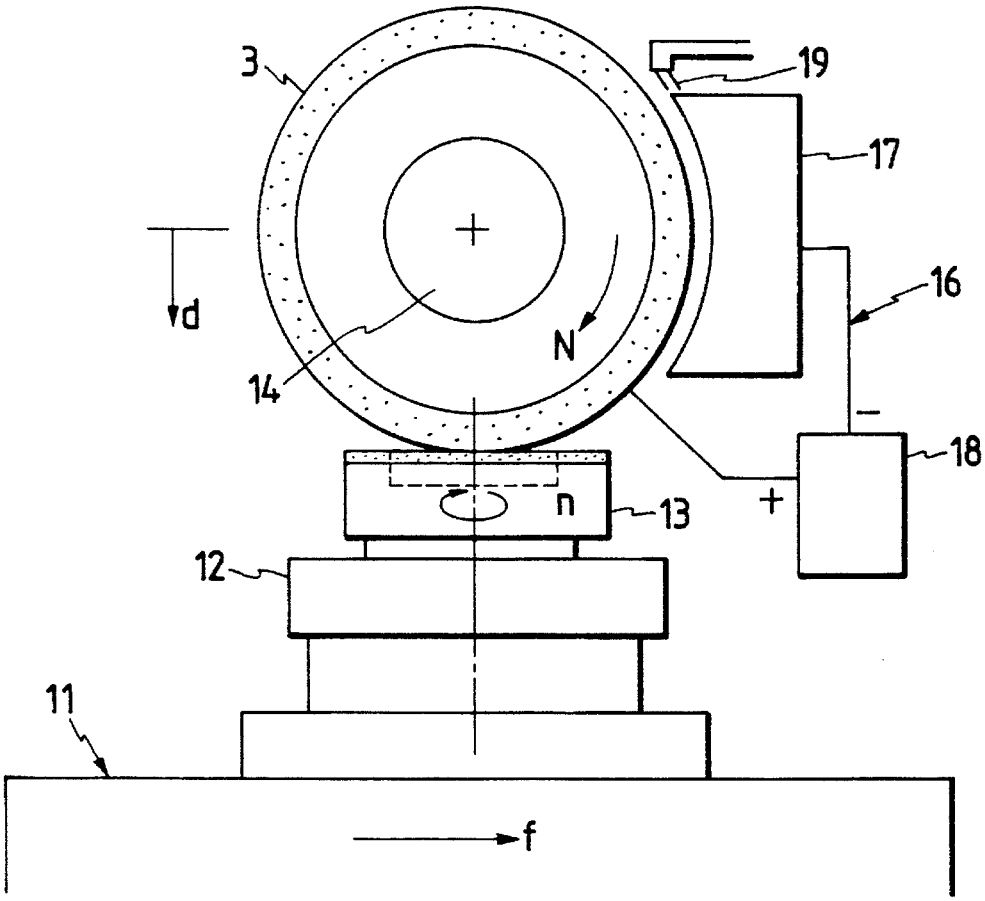
FIG. 16 is a front view showing another embodiment of the truing apparatus of the present invention.
Figure 17A:
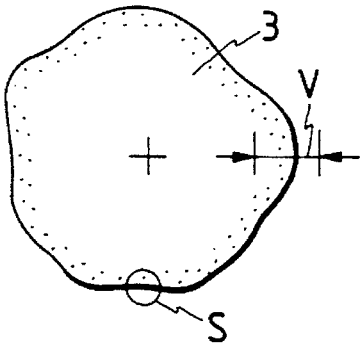
FIG. 17 shows the concept of truing of a diamond grinding tool, FIG. 17(*a*) shows the structure of a metal bond diamond grinding tool before truing, and FIG. 17(*b*) shows the structure of the metal bond diamond grinding tool after truing.
Figure 17B:
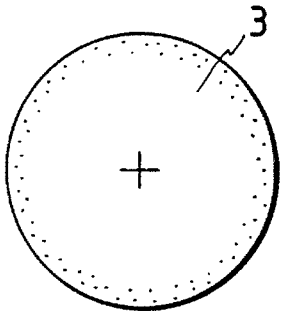
Figure 18:
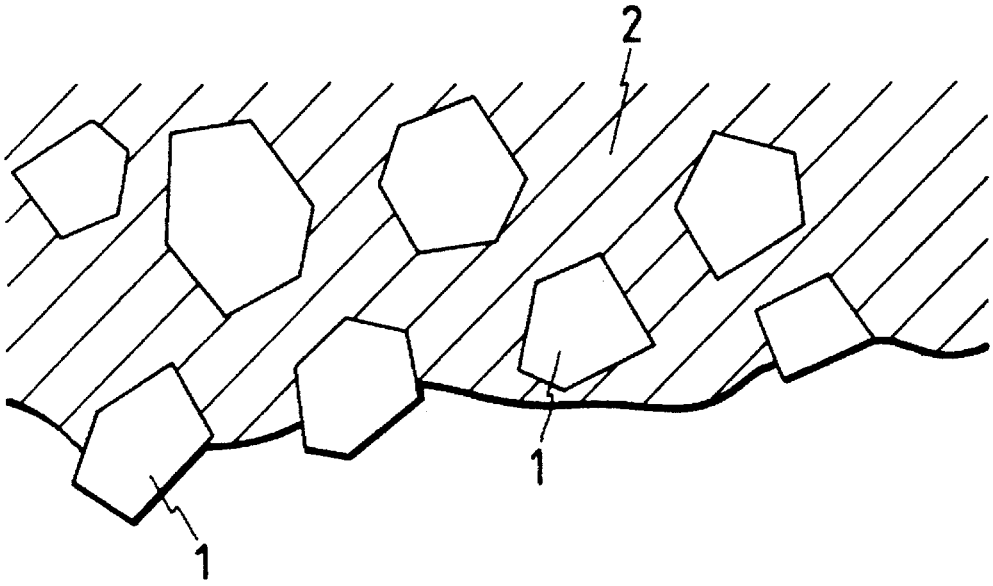
FIG. 18 shows the abrasive grain cutting edge condition of a diamond grinding tool before truing.
Figure 19:
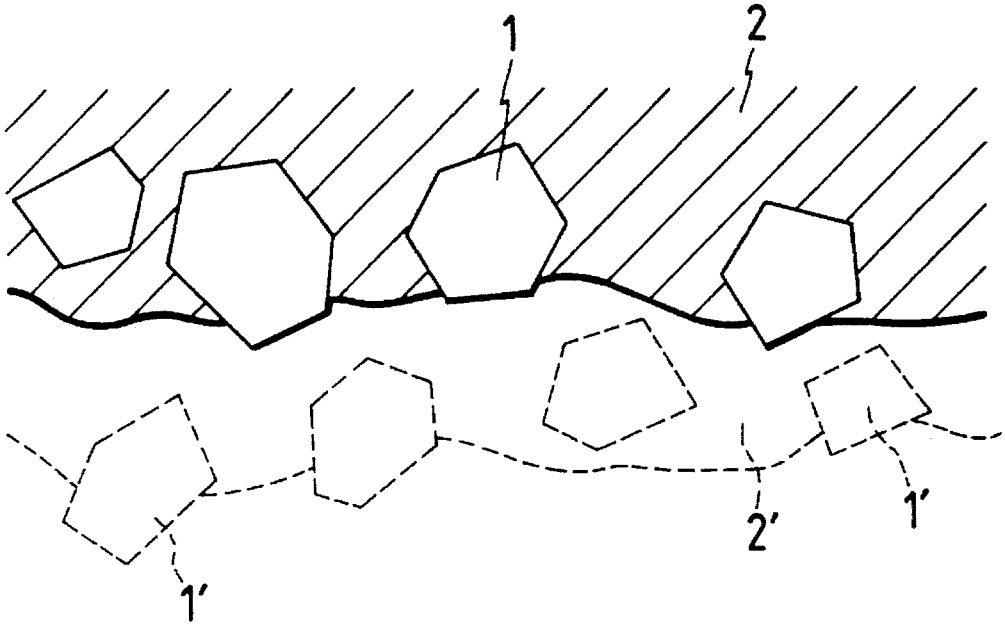
FIG. 19 is a schematic view of the surface condition of a diamond grinding tool which is trued by the conventional truing method.

Furthermore, FIG. 16 is a front view showing another embodiment of the truing apparatus of the present invention.

The truing apparatus of the embodiment shown in FIG. 16 is used for the disc-shaped diamond grinding tool 3 and comprises a spindle 14, a first truing tool 13, an electro chemical dressing apparatus 16, and a second truing tool (not shown in the drawing).

The above spindle 14 is supported by a bearing with static pressure in the same way as the one shown in FIGS. 2 and 3and rotated by an independent rotation drive source. Furthermore, the spindle 14 is fixed.

The above first truing tool 13 is supported by a tool support 12 in the same way as the one shown in FIGS. 2 and 3 and rotated by an independent rotation drive source. The above tool support 12 is mounted on a feed table 11. The above first truing tool 13 is installed so that it can move to the processing position for the diamond grinding tool 3 which is a workpiece supported by the spindle,14, that is, the processing type truing position and to the escaping position.

The above electro chemical dressing apparatus 16 comprises an electrode 17, a DC power source 18, and a means for feeding grinding fluid 19 in the same way as the one shown in FIG. 4. The above members of the electro chemical dressing apparatus 16 are also installed so that they can move to the processing position for the diamond grinding tool 3 supported by the spindle 14, that is, the electro chemical dressing position and to the escaping position.

The above second truing tool is supported by a tool support in the same way as the one shown in FIG. 6 and rotated by an independent rotation drive source. The above tool support is mounted on a feed table. The above second truing tool is also installed so that it can move to the processing position for the diamond grinding tool 3 supported by the spindle 14, that is, the lapping type truing position and to the escaping position.

When truing by using the above truing apparatus, the diamond grinding tool 3 which is a workpiece is attached to the spindle 14 first, and the first truing tool 13 is moved to the processing position together with the tool support 12 thereof and the feed table 11, and the diamond grinding tool 3 and the first truing tool 13 are rotated independently of each other, and the peripheral surface which is a grinding surface of the diamond grinding tool 3 is ground circularly by processing type truing in the same way as mentioned above. After the processing type truing is performed, the first truing tool 13 is moved to the escaping position.

Next, the electro chemical dressing apparatus 16 is moved to the processing position with the diamond grinding tool 3 attached to the spindle 14 and the electrode 17 is arranged at a predetermined interval between the electro chemical dressing apparatus and the diamond grinding tool 3. Since the cathode of the DC power source 18 moves in the state that it is connected to the electrode 17, the anode of the DC power source 18 is connected to the diamond grinding tool 3, and the peripheral surface of the metal bond of the diamond grinding tool 3 is electco-chemically dressed uniformly by rotating the diamond grinding tool 3 via the spindle 14 in the same way as mentioned above. After the dressing is finished, the DC power source 18 is removed from the diamond grinding tool 3 and the electro chemical dressing apparatus 16 is moved to the escaping position.

Next, the second truing tool is moved to the processing position together with the tool support thereof and the feed table with the diamond grinding tool 3 attached to the spindle 14.

Then, the diamond grinding tool 3 which is a workpiece and the second truing tool are rotated independently of each other, and the diamond grinding tool 3 is lapped and trued in the same way as mentioned above so as to lap the tip of each diamond abrasive grain projected from the peripheral surface of the metal bond and to make the cutting edge height constant. After this lapping type truing is finished, the second truing tool is moved to the escaping position and one stroke of truing of the diamond grinding tool 3 is finished.

According to the truing apparatus of the embodiment shown in FIG. 16, the processing type truing, electro chemical dressing, and lapping type truing are performed one by one with the diamond grinding tool 3, which is a workpiece, attached to the spindle 14. Therefore, the attaching error for the diamond grinding tool 3 can be eliminated, and hence the truing can be performed more highly accurately and the above processing can be performed continuously. By doing this, the operation efficiency can be improved.

In this embodiment, by supporting the spindle vertically cup-shaped diamond grinding tools can be trued.

Furthermore, a mechanical dressing apparatus may be used in place of the electro chemical dressing apparatus 16.

Another configuration and operation of this embodiment are the same as those of the embodiments shown in FIGS. 2 to 6 and 14.

Next, further concrete embodiments of the present invention will be described.

Embodiment 1

Using the trying apparatus shown in FIG. 16, a disc-shaped diamond grinding tool 3 is trued as a workpiece so as to grind and form the peripheral surface thereof circularly.

The diamond grinding tool 3 of metal bond 2 is used as a workpiece. This diamond grinding tool 3 has a diameter of 124.5 mm and a thickness of 1.5 μm.

The spindle 14 is supported by a bearing with static pressure air as a bearing with static pressure. The rotation accuracy of the spindle 14 is 0.2 μm and the number of revolutions N of the spindle 14 for truing is 1000 rpm.

A cup-shaped metal bond diamond tool is used as a first truing tool 13. The diamond abrasive grain size of the diamond tool is preferably #200 to #400 and it is necessary that diamond abrasive grains are sufficiently projected from the metal bond. When diamond abrasive grains are projected slightly from the metal bond, it is necessary to dress the metal bond. The number of revolutions n of the first truing tool 13 is 3500 rpm.

In the truing apparatus used in Embodiment 1, the spindle 14 is supported by the bearing with static pressure air and the first truing tool 13 and the spindle 14 are rotated by independent rotation drive sources. Therefore, they are rotated highly rigidly and accurately (the spindle rotation accuracy is 0.2 μm and the rigidity is 80N/μm). When a bearing with static pressure oil is used as a bearing with static pressure, the rigidity increases.

The diamond grinding tool 3 which is a workpiece is attached to the above spindle 14 with a flange and clamp. Since there is a fitting tolerance between the spindle 14 and the diamond grinding tool 3, a run out of several tens μm generally occurs in the diamond grinding tool 3. Even if the setting of the diamond grinding tool 3 for the spindle 14 is modified, a run out of about 10 μm occurs.

The first truing tool 13 is attached onto the tool support 12 so that the side run out is reduced to less than 10 μm.

By rotating the diamond grinding tool 3 via the spindle 14 and rotating the first truing tool 13, the diamond grinding tool 3 is allowed to come into contact with the first truing tool 13 and the feed table 11 is moved in one direction, and the truing is performed under the following conditions.

Truing Conditions

Workpiece: Metal bond diamond grinding tool

First truing tool: SD200Q125M

No. of revolutions N of spindle: 1000 rpm

Feed rate f of feed table: 10.0 mm/min

One-cutting depth d: 1.0 μm

Grinding fluid: Water soluble grinding fluid

Grinding fluid flow rate: 2.0 l/rain

The diamond grinding tool 3 is trued under the above conditions and the run out of the diamond grinding tool 3 is measured after truing.

For measurement of the run out, a positioning sensor is used. With the probe thereof in contact with the peripheral surface (grinding surface) of the diamond grinding tool 3, the run out is measured and recorded.

Figure 7:
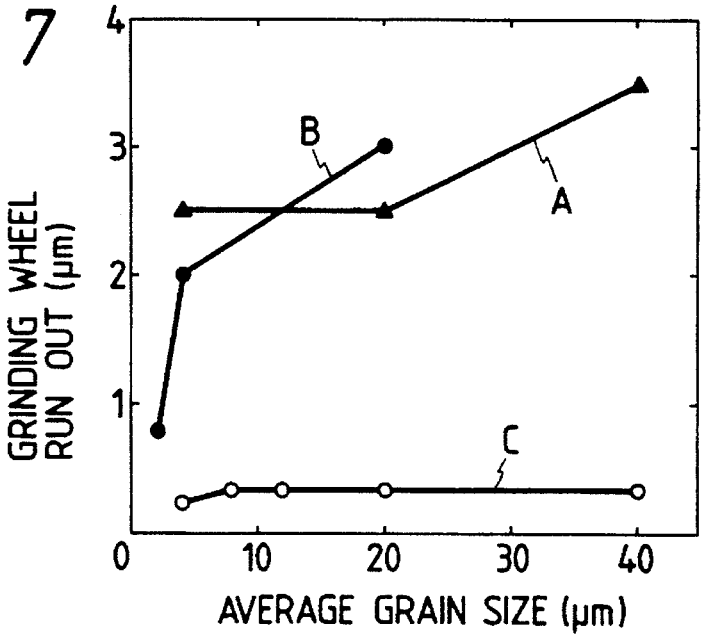
FIG. 7 is a graph showing the measured results of the run out of a diamond grinding tool which is trued.

FIG. 7 is a graph showing the measured results of the run out of diamond grinding tools which are trued.

In FIG. 7, a symbol A indicates the result when diamond grinding tools are trued by the so-called truing method founded on drop out of grain which is a prior art, and a symbol B indicate the result when diamond grinding tools are trued by a truing apparatus on the market which uses a ball bearing as a bearing for supporting the spindle, and a symbol C indicate the result when diamond grinding tools are trued by the so-called processing type truing method of Embodiment 1 using the truing apparatus shown in FIG. 16.

A symbol A shown in FIG. 7 indicates the result when a truing apparatus on the market which supports the spindle with a ball bearing is used and a GC tool is used as a truing tool. The run out of diamond grinding tools which are trued by the truing method founded on drop out of grain which is a prior art is of the order of microns. When the average grain size of diamond grinding tool increases to more than 20 μm, the run out of diamond grinding tools suddenly increases and has a tendency not to be controlled easily.

A symbol B shown in FIG. 7 indicates the result when a truing apparatus on the market which supports the spindle with a ball bearing is,used and a diamond tool is used as a truing tool. The rigidity of this truing apparatus is 3N/μm and the rotation accuracy is 8 μm. Using this truing apparatus, diamond grinding tools are trued in the same way as the processing type truing method. As shown by a symbol B in FIG. 7, the result shows that the run out of diamond grinding tools cannot be reduced.

When diamond grinding tools are trued by the processing type truing method in Embodiment 1, as shown by a symbol C in FIG. 7, the run out of diamond grinding tools can be controlled to less than 0.3 μm regardless of the average grain size of diamond grinding tools.

Figure 8:
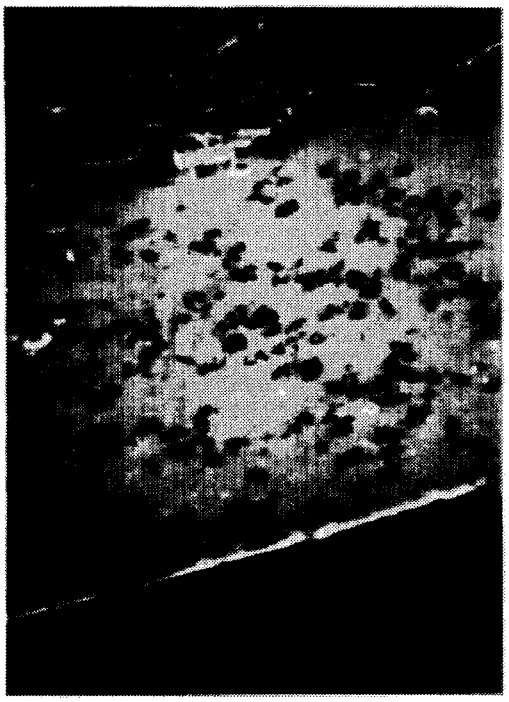
FIG. 8 is a SEM photograph of 100 magnifications of the peripheral surface of a diamond grinding tool which is trued in the processing type truing process of the truing method of the present invention.
Figure 9:
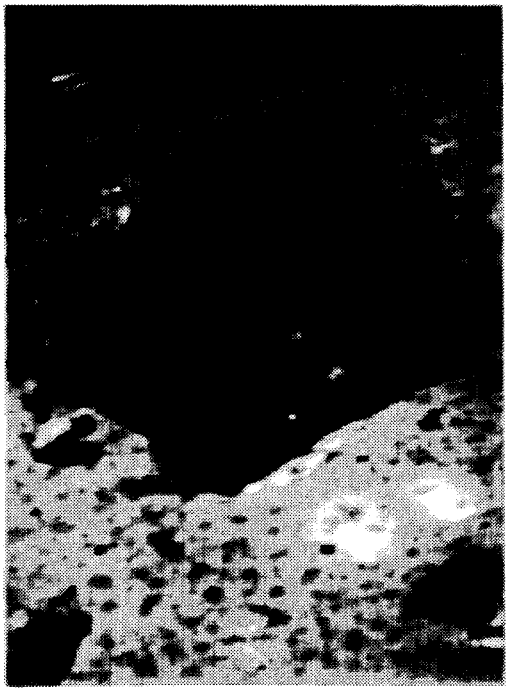
FIG. 9 is a SEM photograph of 2000 magnifications of the peripheral surface of a diamond grinding tool which is trued in the processing type truing process of the truing method of the present invention.

FIG. 8 is a SEM photograph (scanning electron microscope) of 100 magnifications of the peripheral surface of a diamond grinding tool which is ground by the truing method of the present invention and FIG. 9 is a SEM photograph of 2000 magnifications of the above peripheral surface.

When a diamond grinding tool is trued according to Embodiment 1 for the truing method of the present invention, the metal bond surface and the tips of diamond abrasive grains exist in the same surface and no diamond abrasive grain grinding marks can be found as shown in FIGS. 8 and 9.

Embodiment 2

The metal bond 2 of the diamond grinding tool which is trued according to Embodiment 1 is dressed by the electro chemical dressing method.

As mentioned above, when a diamond grinding tool is trued, the metal bond and the tips of diamond abrasive grains exist in the same surface. Therefore, when the diamond grinding tool is used as a grinding tool as it is, the metal bond surface comes into contact with a workpiece and normal grinding is not performed. Therefore, dressing for projecting the tips of diamond abrasive grains from the metal bond surface is necessary.

In this Embodiment 2, the electro chemical dressing method is used as a dressing method.

The electro chemical dressing method uses the electro chemical dressing apparatus 16 shown in FIG. 16.

The electrode 17 is arranged at an interval g of 0.10 to 0.15 mm between the electro chemical dressing apparatus and the peripheral surface of the diamond grinding tool 3 which is a workpiece. The anode of the DC power source 18 is connected to the diamond grinding tool 3 and the cathode is connected to the electrode 17. Grinding fluid 19 is fed into the gap between the above diamond grinding tool 3 and the electrode 17, and an electric current is supplied to the diamond grinding tool 3 and the electrode 17, and the diamond grinding tool 3 is rotated, and the metal bond 2 is dressed under the following electro chemical dressing conditions.

Electro Chemical Dressing Conditions

Workpiece: Metal bond diamond grinding tool

Interval g between workpiece and electrode: 0.13 mm

Applied voltage: 30 V

No. of revolutions of workpiece: 2000 rpm

Grinding fluid: Water soluble grinding fluid

Grinding fluid flow rate: 6.0 l/min

Dressing time: 1.0 minute

When the metal bond 2 is dressed under the above electro chemical dressing conditions, the surface of the metal bond 2 can be uniformly removed to a mean value of 3 μm in the radial direction and the tips of diamond abrasive grains 1 can be projected sufficiently.

Embodiment 3

The surface of the metal bond 2 is removed by the electro chemical dressing method, and the diamond abrasive grains 1 are projected, and then the tips of the diamond abrasive grains 1 are lapped by the truing apparatus shown in FIG. 16.

As mentioned above, the diamond grinding tool 3 wherein only the metal bond 2 thereof is removed and the tips of the diamond abrasive grains 1 are projected cannot be used, for example, for grinding at the critical cutting depth of a brittle material in the ductile mode or for grinding the surface of a magnetic head which is opposite to a recording medium to processed surface roughness similar to that by lapping. When using the diamond grinding tool 3 for those uses, it is necessary to lap the tips of the diamond abrasive grains 1 projected from the metal bond 2 and to make the cutting edge height of the diamond abrasive grains 1 constant.

Therefore, the tips of the diamond abrasive grains 1 projected from the surface of the metal bond 2 are trued by the lapping type truing method so as to make the cutting edge weight of the diamond abrasive grains 1 constant. A cup-shaped plate made of cast iron is attached and used as a second truing tool. By rotating the above diamond grinding tool 3 by the spindle 14 and the rotation drive source and rotating the second truing tool by another rotation drive source, the peripheral surface of the diamond grinding tool 3 is allowed to come into contact with the top of the second truing tool. Then, the diamond grinding tool 3 is cut and fed little by little, and the feed table is moved at a predetermined feed rate, and the truing is performed under the following conditions.

Truing Conditions

Workpiece: Metal bond diamond grinding tool

Second truing tool: Plate made with cast iron (FC20)

No. of revolutions n of second truing tool: 3500 rpm

No. of revolutions N of spindle: 1000 rpm

Feed rate f of feed table: 5.0 mm/min

One-cutting depth d: 0.2 μm

Under the above truing conditions, the tips of diamond abrasive grains 1 of the diamond grinding tool 3 are trued by the lapping type truing method and the cutting edge height of the diamond abrasive grains 1 is measured.

Figure 10:
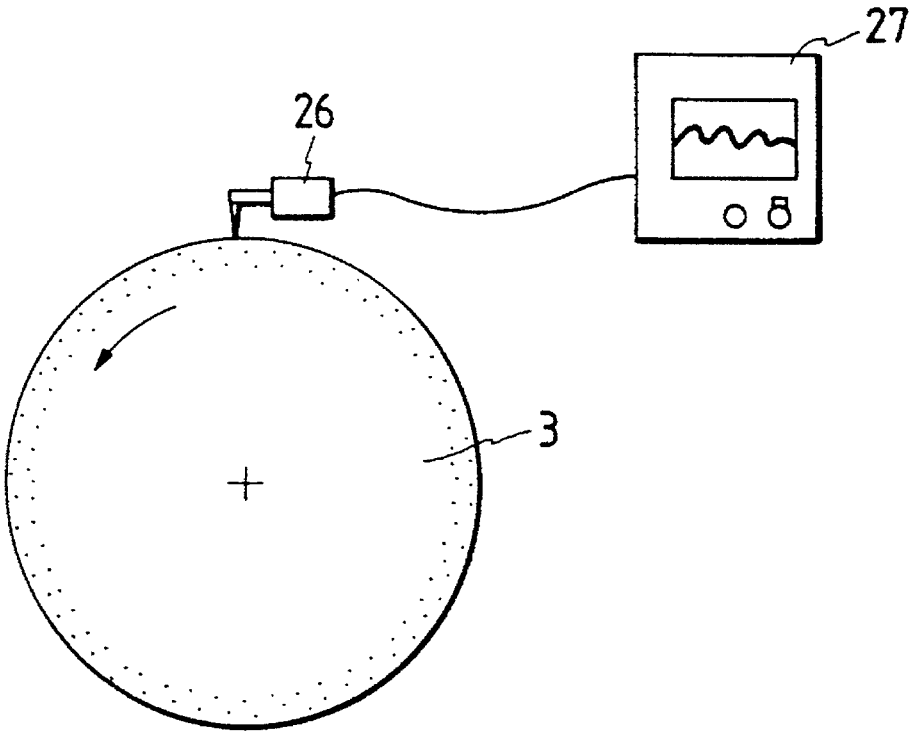
FIG. 10 is a conceptual diagram of a measuring apparatus for the abrasive grain cutting edge height of a grinding tool.
Figure 11:
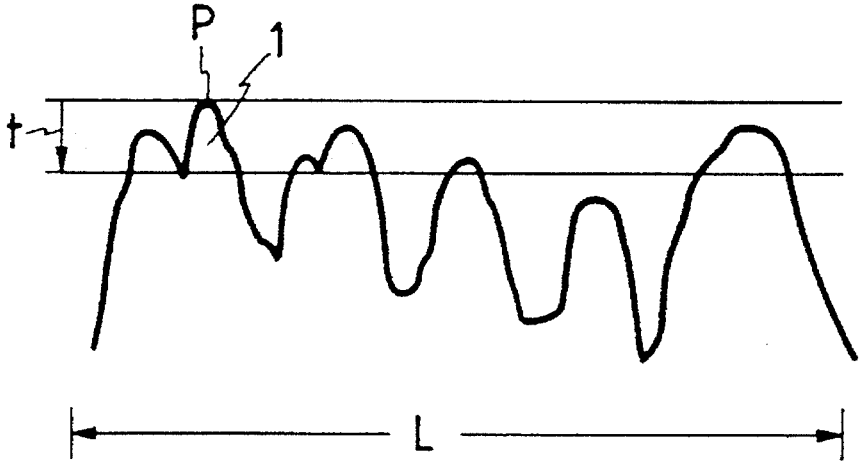
FIG. 11 is an illustration for the method of estimation of measured data obtained by the measuring apparatus shown in FIG. 10.

FIG. 10 is a conceptual diagram of a measuring apparatus for the abrasive grain cutting edge height of a grinding tool and FIG. 11 is an illustration for the method of estimation of measured data obtained by the measuring apparatus shown in FIG. 10.

The cutting edge height of the diamond abrasive grains 1 of the diamond grinding tool 3 is measured using the measuring apparatus for abrasive grain cutting edge height shown in FIG. 10 and is processed by the method of estimation of measured data shown in FIG. 11.

A probe type positioning sensor 26 of the measuring apparatus for abrasive grain cutting edge height shown in FIG. 10 is allowed to touch the peripheral surface of the diamond grinding tool 3 after the diamond abrasive grains 1 are lapped, and the diamond grinding tool 3 is rotated at a very slow speed, and the two-dimensional profile of the peripheral surface of the diamond grinding tool 3 is measured and recorded in a recorder 27.

As a method 3f estimation of truing accuracy, a reference length L is set in the obtained measured data as shown in FIG. 11, and the tip of the diamond abrasive grain which is projected most among the diamond abrasive grains 1 within the reference length L is assumed as a reference point P, and a reference height range t is set from this reference point P, and the number of tips of diamond abrasive grains 1 is counted.

As a result, a metal bond diamond grinding tool with diamond abrasive grain accuracy of 800 is estimated by the above estimation method for a case that the metal bond diamond grinding tool is trued by a truing apparatus (a ball bearing is used to support the spindle, rigidity 3N/μm, rotation accuracy 8 μm) on the market with a GC tool attached as a conventional truing method and for a case that the metal bond diamond grinding tool is trued according to Embodiments 1, 2, and 3 by the truing method of the present invention. The estimation shows that the number of tips of diamond abrasive grains located within the reference length L of 1 mm and the reference height range t of 0.5 μm, that is, the number of cutting edges is 4 in the diamond grinding tool trued by the conventional truing method and 4.2 in the diamond grinding tool 3 trued according Embodiments 1, 2, and 3 by the truing method of the present invention. The measurement result shows that the cutting edge height of the diamond abrasive grains 1 of the diamond grinding tool 3 trued by the truing method of the present invention is constant.

Figure 12:
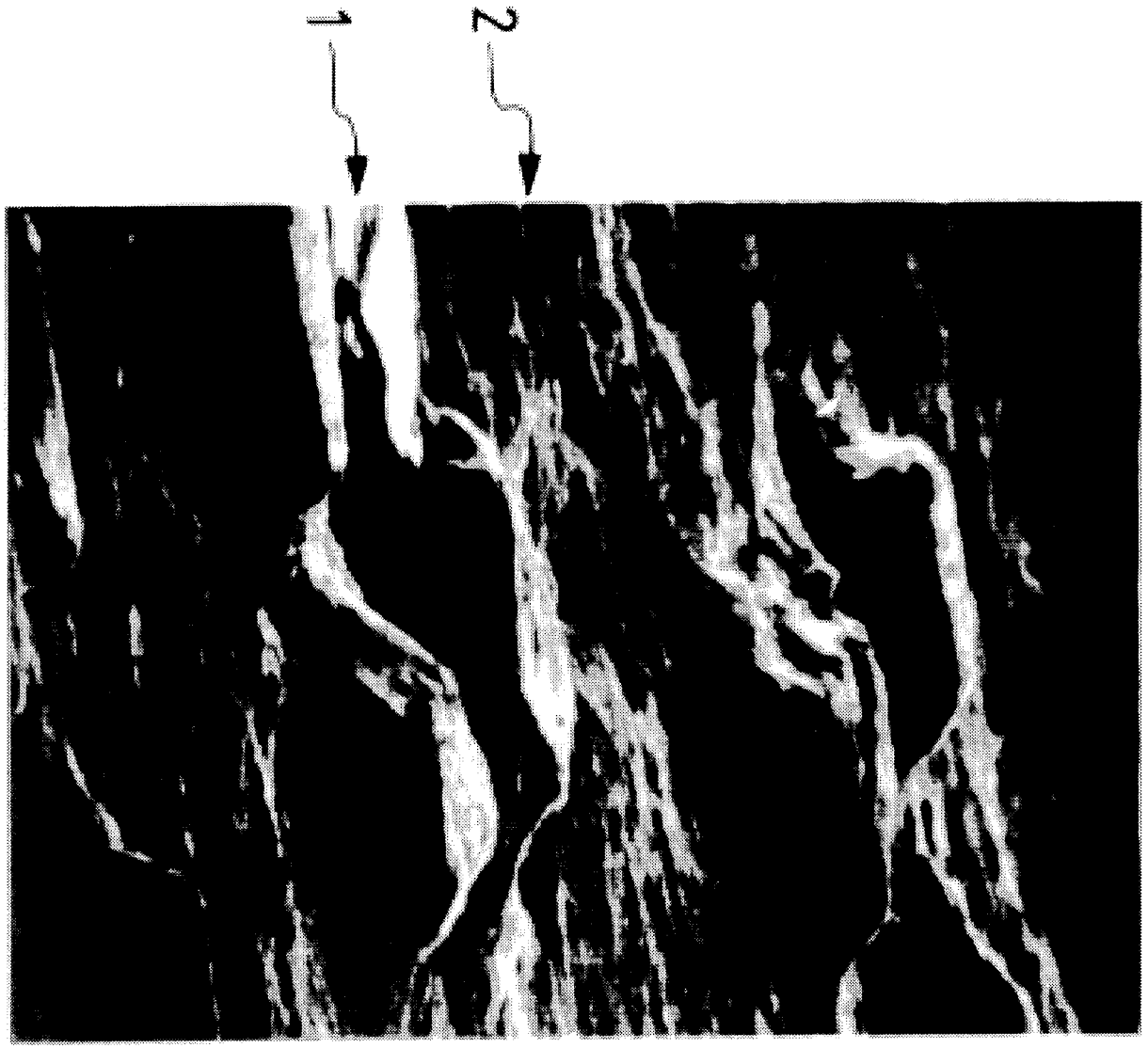
FIG. 12 is a SEM photograph of the peripheral surface of a diamond grinding tool which is a product trued by the truing method of the present invention.

FIG. 12 is a SEM photograph of the peripheral surface of a diamond grinding tool which is a product trued by the truing method of the present invention.

FIG. 12 shows that when the tips of diamond abrasive grains 1 projected from the surface of the metal bond 2 are lapped by a plate made of cast iron according to Embodiment 3, the cutting edge section of each diamond abrasive grain 1 is formed almost flat and the cutting edge height of many diamond abrasive grains 1 is constant.

Embodiment 4

Test samples are grooved using a diamond grinding tool 3 which is trued by the truing method of the present invention and a diamond grinding tool which is trued by the conventional truing method and the processed surface roughness of each groove is measured. The test samples are made of alumina titanium carbide.

A truing apparatus (a ball bearing is used to support the spindle, rigidity 3N/um, rotation accuracy 8 μm) on the market is used as a conventional truing method. A GC tool is attached to this truing apparatus as a truing tool.

Embodiments 1, 2, and 3 are used for truing as a truing method of the present invention.

The processing conditions for grooving by the diamond grinding tool trued by the conventional truing method and by the diamond grinding tool 3 trued by the truing method of the present invention are as shown below.

Processing Conditions

Grinding tool: Metal bond diamond grinding tool

Test sample: Alumina titanium carbide

No. of revolutions of spindle of processing machine: 4000 rpm

Feed rate of feed table of processing machine: 100 mm/min

One-cutting depth: 2.0 μm

Figure 13:
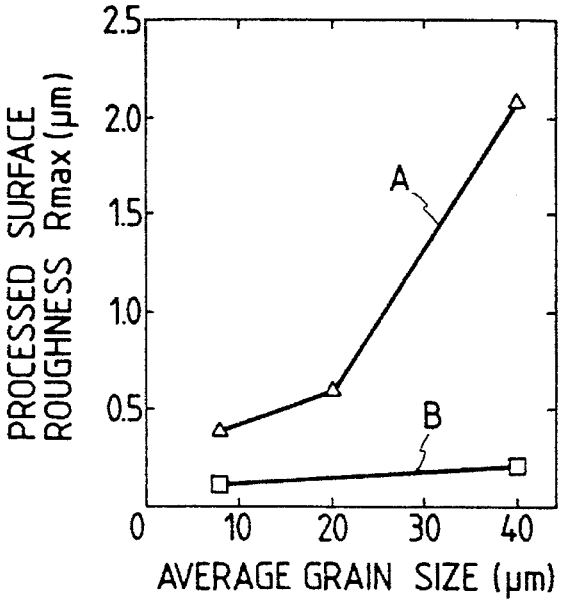
FIG. 13 is a graph showing the experimental results of the processed surface roughness ground by a diamond grinding tool.

FIG. 13 is a graph showing the experimental results of the processed surface roughness ground by a diamond grinding tool.

In the experiment shown in FIG. 13, the processed surface roughness is measured roughness of the processed surface ground by the peripheral surface of the diamond grinding tool. In FIG. 13, a symbol A indicates the experimental result when a diamond grinding tool trued by the conventional truing method, that is, a diamond grinding tool trued by a truing apparatus (a ball bearing is used to support the spindle, rigidity 3N/μm, rotation accuracy 8 μm) on the market with a GC tool attached is used for grinding. A symbol B shown in FIG. 13 indicates the experimental result when a diamond grinding tool trued according to Embodiments 1, 2, and 3 by the truing method of the present invention is used for grinding.

FIG. 13 shows that when ground by the diamond grinding tool trued by the truing method of the present invention, a good processed surface such that the processed surface roughness is 0.2 μm Rmax. is obtained even when diamond abrasive grains are coarse such that the average grain size is 40 um. When the diamond grinding tool trued by the conventional truing method is used, the processed surface roughness gets worse when the average grain size of diamond abrasive grains exceeds 20 μm. When the average grain size is 40 μm, the processed surface roughness is 2.1 μm Rmax. This experimental result shows that a diamond grinding tool trued by the truing method of the present invention improves the processed surface roughness extremely. This is because the cutting edge height of diamond abrasive grains is made constant by the truing method of the present invention.

Embodiment 5

Figure 20:
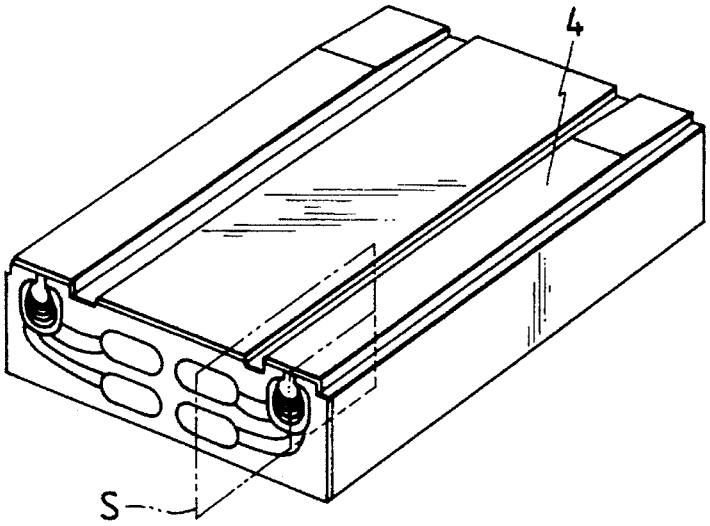
FIG. 20 is a perspective view of a magnetic head.
Figure 21:
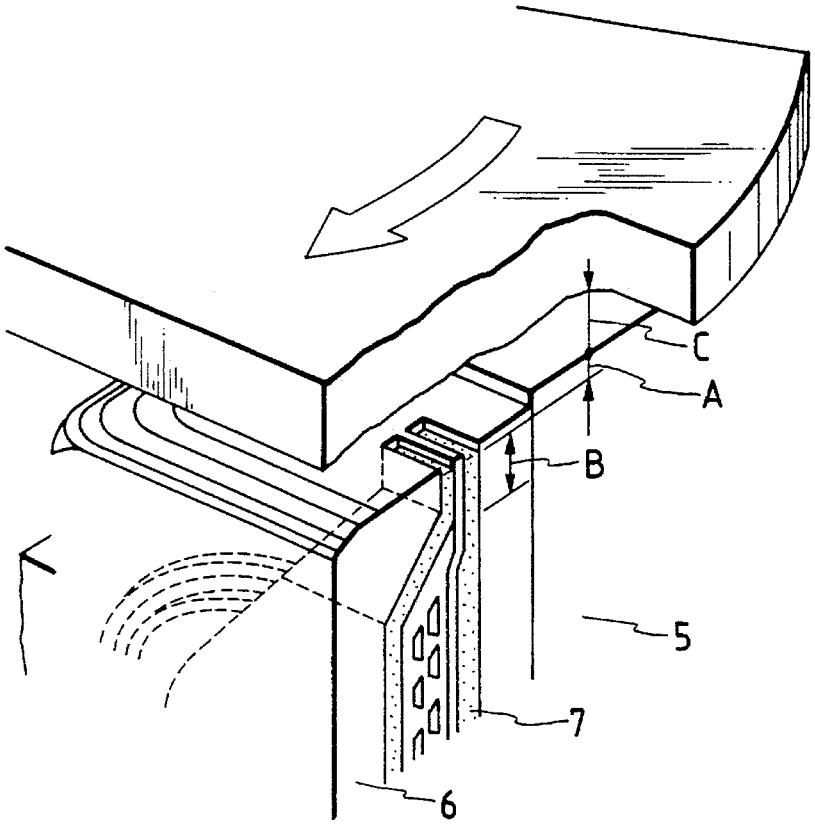
FIG. 21 is an enlarged view of the section S shown in FIG. 20.

A cup-shaped diamond grinding tool trued by the truing method of the present invention is attached to a surface grinding machine as a tool, and the air bearing surface, that is, the surface of a magnetic head for a magnetic disk, shown in FIG. 20, which is opposite to a recording medium is processed by this diamond grinding tool. The air bearing surface can be processed to a processed surface roughness of 0.1 μm Rmax. Furthermore, the micro step formed by processing which is the difference in processing depth of the composite material of the magnetic head can be reduced from 0.05 μm to 0.02 μm in the case of lapping. By such a reduction in the micro step formed,by processing, the interval between a magnetic medium of the magnetic head and the magnetic disk surface can be narrowed and the recording density can be increased. In other words, when the recording density is the same, the air bearing distance (the interval between substrate 5 and the magnetic disk) of the magnetic head can be increased in correspondence with the reduction in the micro step formed by processing and hence a danger of crushing can be minimized. Therefore, the reliability of the magnetic disk unit can be improved.

On the air bearing surface of a magnetic head finished by grinding, regular grinding marks of the order of 10 nm are formed in a fixed direction. By them, the frictional force when the magnetic head is in contact with the magnetic disk is reduced, and a danger of crushing is minimized, and the reliability of the magnetic disk unit is improved.

Therefore, although lapping is conventionally used as finishing of a magnetic head, a magnetic head which is processed only by grinding can be manufactured.

Although lapping is used for finishing an optical head or an optical system using glass as a material at present, grinding may be used instead of lapping in the same way as with the above magnetic head.

Next, various another embodiments of the present invention will be described.

According to the present invention, not only metal bond but also resin bond may be used as bond for diamond abrasive grains. When resin bond is used, the conventional mechanical dressing method is used for projecting diamond abrasive grains in place of the electro chemical dressing method.

According to the present invention, the tips of diamond abrasive grains projected from the bond surface are lapped only by a plate made of cast iron. However, diamond abrasive grains may be fed onto the plate for lapping. Furthermore, another lapping tool may be used in place of the plate made of cast iron.

Furthermore, according to the present invention, the first truing tool 13 and the second truing tool 24 may be exchanged and attached to a single truing apparatus so as to use the single truing apparatus as a first truing apparatus and a second truing apparatus.

The present invention, which is described above in detail, obtains good results indicated below.

A diamond grinding tool wherein the run out of the grinding surface is extremely small and the cutting edge height of diamond abrasive grains is made constant precisely can be provided; a diamond grinding tool truing method which can surely form a diamond grinding tool for truing the above diamond grinding tool is provided; furthermore, a diamond grinding tool truing apparatus which can exactly execute the above diamond grinding tool truing method is provided; and by using a grinding tool trued in this way, a magnetic head wherein at least the surface which is opposite to a recording medium is finished by grinding to good processed surface roughness with high shape accuracy can be provided.

The above good results are obtained as concrete good results indicated below in correspondence with a concrete configuration.

When a disc-shaped diamond grinding tool of the present invention is used, the grinding surface of the above grinding tool is ground circularly, and the above abrasive grains are projected from the bond surface by a predetermined distance, and the tips of the projected abrasive grains are formed almost flat. Therefore, the diamond abrasive grain cutting edge height can be made precisely constant and hence the diamond grinding tool can be applied to ultra precision grinding of brittle materials in the ductile mode or to finishing of the surface of a magnetic head which is opposite to a recording medium by grinding.

When a cup-shaped diamond grinding tool of the present invention is used, the grinding surface of the above grinding tool is ground to a highly accurate flat surface, and the above abrasive grains are projected from the bond surface by a predetermined distance, and the tips of the projected diamond abrasive grains are formed almost flat. Therefore, also in the invention according to claim 2, the diamond grinding tool can be applied to ultra precision grinding of brittle materials in the ductile mode or to finishing of the surface of a magnetic head which is opposite to a recording medium by grinding.

When a disc-formed diamond grinding tool of the present invention is used as a workpiece, and a diamond tool is used as a truing tool, and the peripheral surface of the workpiece which is the grinding surface of the above diamond grinding tool is ground circularly by the truing tool, the effect on the run out of the grinding tool can be minimized and hence the run out of the diamond grinding tool can be controlled to the order of submicrons. Then, the bond surface is uniformly dressed so as to project diamond abrasive grains of the workpiece from the bond surface by a predetermined distance, and then the tip of each diamond abrasive grain projected from the above bond surface is lapped almost flat by the truing tool. Therefore, the abrasive grain cutting edge height can be made precisely constant and the diamond grinding tool can be trued so that the effect of the grain size can be minimized even if the grain size of the grinding tool is large.

When a cup-shaped diamond grinding tool of the present invention is used as a workpiece, and a diamond tool is used as a truing tool, and the end face of the workpiece which is the grinding surface of the above diamond grinding tool is ground to a highly accurate flat surface by the truing tool, the bond surface is uniformly dressed so as to project diamond abrasive grains of the workpiece from the bond surface by a predetermined distance, and then the tip of each diamond abrasive grain projected from the above bond surface is lapped almost flat by the truing tool. Therefore, also in the invention according to claim 4, the run out of the grinding surface of the diamond grinding tool can be controlled to the order of submicrons and the diamond grinding tool can be trued so that the effect of the grain size can be minimized even if the grain size of the grinding tool is large.

In a diamond grinding tool of the present invention wherein diamond abrasive grains are secured with metal bond, an electrode is arranged opposite to the grinding surface of the diamond grinding tool which is a workpiece at a predetermined interval, and the anode of the power source is connected to the above workpiece and the cathode of the power source is connected to the above electrode, and an electric current is supplied to the above workpiece and electrode, and the workpiece is rotated so as to uniformly dress the above metal bond surface electrochemically. Therefore, even when metal bond with high holding stiffness is used as bond, it is possible to electrolyze the metal bond, to uniformly remove the bond surface without breaking the diamond abrasive grain cutting edge condition, and to easily project the cutting edges which are tips of the diamond abrasive grains.

A plate made with iron group metal is used as a truing tool for lapping the tip of each diamond abrasive grain projected from the above bond of the present invention, and the above workpiece and plate are rotated, and the tips of the diamond abrasive grains are lapped by the above plate. When the diamond and iron are lapped with each other, a chemical reaction that carbon contained in the diamond is absorbed into the iron is produced. Therefore, using this chemical reaction, the diamond abrasive grain cutting edge height can be made constant surely and highly accurately.

According to the configuration of the present invention that a first truing apparatus, a dressing apparatus, and a second truing apparatus are arranged, the above first truing apparatus comprises a spindle which is supported by a bearing with static pressure and supports a diamond grinding tool which has many diamond abrasive grains secured with bond as a workpiece, a rotation drive source for this spindle, a first truing tool for grinding the grinding surface of the diamond grinding tool which is the workpiece, a rotation drive source for this first truing tool, and a cutting means for feeding the above first truing tool and diamond grinding tool which is the workpiece relatively in the cutting direction, and the above dressing apparatus is structured so as to project the diamond abrasive grains by a predetermined distance by uniformly removing the above bond surface, and the above second truing apparatus comprises a spindle which is supported by a bearing with static pressure and supports a dressed diamond grinding tool as a workpiece, a rotation drive source for this spindle, a second truing tool for lapping the tip of each diamond abrasive grain which is projected from the above bond surface so as to align the cutting edges, a rotation drive source for this second truing tool, and a cutting means for feeding the above second truing tool and diamond grinding tool which is the workpiece relatively in the cutting direction. Particularly in the first and second truing apparatuses, the spindles are supported by the bearings with static pressure and rotated by the independent rotation drive sources. Therefore, the spindle holding stiffness and the rotation accuracy can be extremely improved and hence the truing method of the present invention can be executed exactly.

According to the above configuration of the present invention, a first truing tool and second truing tool are selectively attached to a single truing apparatus and the single truing apparatus serves as the above first truing apparatus and second truing apparatus. Therefore, the cost of equipment can be cut down and the installation space of equipment can be narrowed.

According to another configuration of the present invention, the position of the above spindle for supporting a diamond grinding tool which is a workpiece is fixed and the above first truing tool, dressing apparatus, and second truing tool can be moved to the processing position and escaping position for the workpiece. Therefore, the processing type truing for grinding the grinding surface of the diamond grinding tool with the diamond grinding tool attached to the spindle, the dressing for projecting the tips of diamond abrasive grains from the bond surface, and the lapping type truing for lapping the tips of diamond abrasive grains so as to make the cutting edge height constant can be performed one by one. Therefore, the diamond grinding tool attaching error can be eliminated and hence workpieces can be trued with higher accuracy and the operation efficiency can be increased.

According to the configuration that a cup-shaped metal bond diamond tool is used as a first truing tool, a cup-shaped plate made with iron group metal is used as a second truing tool. Furthermore, in a diamond grinding tool which has diamond abrasive grains secured with metal bond, the above dressing apparatus comprises an electrode which is arranged opposite to the above diamond grinding tool at a predetermined interval, a power source wherein the anode is connected to the diamond grinding tool which is the workpiece and the cathode is connected to the electrode, and a rotation drive source for the above diamond grinding tool. Therefore, the above truing methods of the present invention can be executed more satisfactorily.

By finishing at least the surface of a magnetic head which is opposite to a recording medium by grinding using a highly precise grinding tool of the present invention which is trued as mentioned above, the surface opposite to the recording medium can be finished to a good processed surface roughness with high shape accuracy and hence high density recording onto a recording medium is available and the cost can be cut down substantially.

What is claimed is:

1. A grinding tool truing method, comprising:

a step of truing a grinding surface of a grinding tool which has many abrasive grains secured with bond, said abrasive grains being embedded in said bond;

a step of uniformly dressing the bond surface of the trued grinding surface for projecting the embedded abrasive grains on said grinding surface from said bond surface by a predetermined height; and a step of lapping cutting edges of said abrasive grains projected from said bond surface, to be lapped on a target surface to which an object is to be ground, by use of a lapping surface of a truing tool, said lapping surface including a material chemically reactive with said abrasive grains for lapping.

2. A grinding tool truing method, comprising:

a step of truing a circular grinding surface of a disk-shaped diamond tool which has many diamond abrasive grains secured with bond, said diamond abrasive grains being embedded in said bond;

a step of uniformly dressing the trued circular grinding surface for projecting the embedded abrasive grains from the bond surface by a predetermined height; and a step of lapping cutting edges of said abrasive grains projected from said bond surface, to be lapped on a target surface to which an object is to be ground, by use of a lapping surface of a truing tool, said lapping surface including an iron family element.

3. A diamond grinding tool truing method, comprising:

a step of grinding a grinding surface of a cup-shaped diamond tool which has many diamond abrasive grains secured with bond to a flat surface by a first truing tool whose surface comprises another diamond tool;

a step of uniformly dressing said flat surface for projecting said abrasive grains from said flat surface by a predetermined height from the bond surface of said flat surface; and a step of lapping cutting edges of said abrasive grains projected from said bond surface, to be lapped on a target surface to which an object is to be ground, by use of a lapping surface of a second truing tool, said lapping surface including an iron family element.

4. A truing method according to claim 2, wherein said bond is a metal bond and said step of uniformly dressing includes arranging a dressing surface of an electrode which is in parallel with the grinding surface of said grinding tool to be opposed to said grinding surface at a predetermined interval, connecting a cathode of a power source to said electrode and an anode thereof to said tool for supplying an electric current therebetween for electrochemically dressing the bond surface.

5. A truing method according to claim 2, wherein said abrasive grains are diamond abrasive grains and the chemically reactive material is an iron family metal.

6. A truing method according to claim 5, wherein the grinding surface of said grinding tool is a circular grinding surface, and said step of uniformly dressing further comprises rotating said grinding tool supplying said electric current.

7. A truing method according to claim 6, wherein the grinding surface of said grinding tool is a circular grinding surface and said step of lapping further comprises lapping said cutting edges which are in contact with said lapping surface.

8. A diamond grinding tool truing apparatus, comprising:

a spindle for supporting a circular diamond grinding tool having many diamond abrasive grains on its grinding surface and secured by bond, said spindle being supported by a bearing with static pressure;

a rotation drive source for said spindle;

a first truing tool having a truing surface for truing a grinding surface of said diamond grinding tool;

a rotation drive source for said first truing tool;

means for relatively feeding said truing surface of said truing tool and said grinding surface of said diamond grinding tool in contact therewith;

a dressing apparatus for uniformly removing bond on said grinding surface of said diamond grinding tool, to project said diamond abrasive grains by a predetermined height;

a second truing tool having a lapping surface for lapping tips of the projected diamond abrasive grains for aligning cutting edges of said diamond abrasive grains, said lapping surface comprising a material that is chemically abrasive with said abrasive grains for lapping;

a rotation drive source for driving said second driving tool; and means for relatively feeding said lapping surface of said second truing tool and said grinding surface of said diamond grinding tool to be in contact.

9. A diamond grinding tool truing apparatus according to claim 8, wherein said first truing tool and said second truing tool are constructed and can be installed as a single truing apparatus allowing for selection between said first and second truing tools.

10. A truing apparatus according to claim 9, wherein the position of said spindle for supporting the diamond grinding tool as a workpiece is fixed, and said first truing tool, said dressing apparatus, and said second truing tool can be moved to the processing position and the escaping position of said workpiece.

11. A truing apparatus according to claim 9, wherein a cup-shaped metal bond diamond tool is used as the first truing tool.

12. A truing apparatus according to claim 9, wherein a cup-shaped truing tool having a lapping surface made of an iron family metal is used as said second truing tool.

13. A truing apparatus according to claim 9, wherein said dressing apparatus is for arranging a dressing surface of an electrode which is in parallel with the grinding surface of said diamond grinding tool to be opposed to said grinding surface at a predetermined interval, connecting a cathode of a power source to said electrode and an anode thereof to said tool for supplying an electric current therebetween for electrochemically dressing the bond surface.

14. A grinding tool truing method comprising:

a step of lapping cutting edges of abrasive grains on the surface of said grinding tool, to be lapped on a target surface to which an object is to be ground by said grinding tool, by use of a lapping surface of a truing tool, said lapping surface including a material chemically reactive with said abrasive grains for lapping.

15. A grinding tool truing method according to claim 2, wherein the chemically reactive material of said lapping surface of said truing tool is a material which absorbs elements of said abrasive grains.

16. A grinding tool truing method according to claim 3, wherein said elements of said abrasive grains are diamond elements, and said chemically reactive material is an iron family element.

* * * * *